US006563097B2

(12) United States Patent
Taino et al.

(10) Patent No.: US 6,563,097 B2
(45) Date of Patent: May 13, 2003

(54) MICROWAVE OVEN WITH FOOD SEARCH AND LOCALIZED HEATING

(75) Inventors: Kazuo Taino, Shiga (JP); Hiroyasu Kitagawa, Hikone (JP); Kazuko Tanaka, Shiga (JP); Yoshiko Yamane, Kusatsu (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 10/084,830

(22) Filed: Feb. 26, 2002

(65) Prior Publication Data

US 2002/0162836 A1 Nov. 7, 2002

(30) Foreign Application Priority Data

Feb. 28, 2001 (JP) ..... 2001-055038

(51) Int. Cl.[7] ..... H05B 6/68

(52) U.S. Cl. ..... 219/711; 219/749; 219/756; 219/748; 374/149

(58) Field of Search ..... 219/710, 711, 219/746, 747, 748, 749, 756; 374/149

(56) References Cited

U.S. PATENT DOCUMENTS

| | | | | |
|---|---|---|---|---|
| 2,909,635 A | * | 10/1959 | Haagensen | 219/746 |
| 5,986,249 A | | 11/1999 | Yoshino et al. | 219/746 |
| 6,169,277 B1 | * | 1/2001 | Feher et al. | 219/702 |

FOREIGN PATENT DOCUMENTS

| | | | | |
|---|---|---|---|---|
| JP | 3-129695 | * | 6/1991 | 219/746 |
| JP | 9-027389 | * | 1/1997 | |

* cited by examiner

*Primary Examiner*—Philip H. Leung
(74) *Attorney, Agent, or Firm*—Darby & Darby

(57) ABSTRACT

A microwave oven heats all food in an appropriate manner even if food items are simultaneously placed at multiple locations in a heating chamber. An auxiliary antenna is periodically stopped at an orientation corresponding to a position where a lowest temperature was detected at the start of the heating operation. Between stopped periods, the auxiliary antenna is rotated for a period to apply heat evenly to all food in the oven. If multiple low-temperature points are detected, the central position of these multiple low-temperature points is used for applying concentrated heat.

5 Claims, 22 Drawing Sheets

FIG.6A
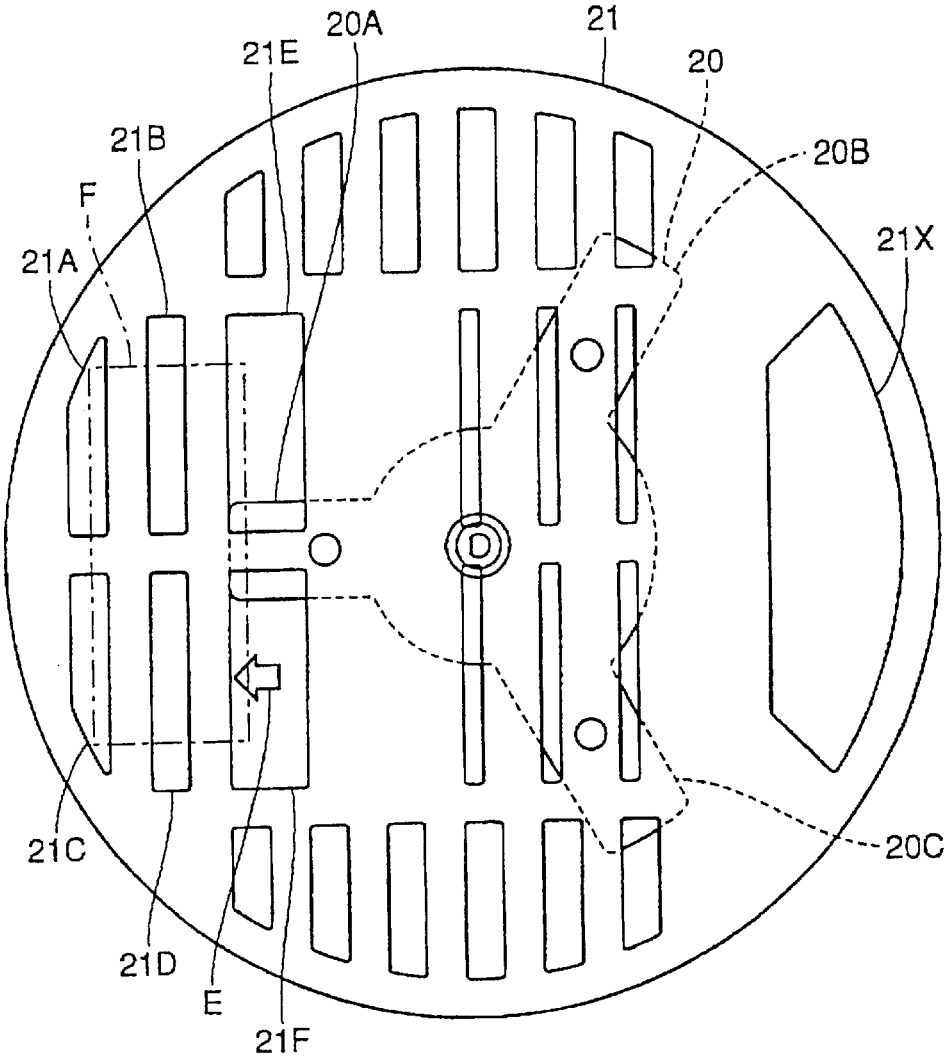
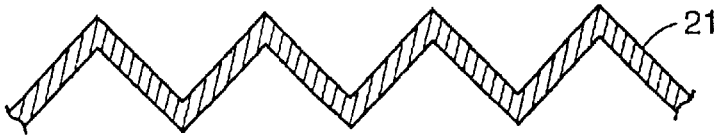
FIG.6B

| FIG.18A | FIG.18B |
|---|---|

MICROWAVE OVEN WITH FOOD SEARCH AND LOCALIZED HEATING

BACKGROUND OF THE INVENTION

The present invention relates to a microwave oven. More specifically, the present invention relates to a microwave oven that can apply localized heat in a specific location in said heating chamber.

A conventional microwave oven described in Japanese Patent Number 2,894,250 seeks to provide localized heating in the location where food is placed in a heating chamber. More specifically, the placement location of food is determined based on the distribution of temperature increases in the heating chamber when the entire heating chamber is evenly heated. Localized heat is applied to this location.

If it is determined that multiple food items are placed in the heating chamber, this microwave oven performs localized heating at the center of the multiple food placement positions.

However, energy efficiency in this microwave oven is reduced if multiple food items are placed in the heating chamber. Thus, it could not be said that appropriate heating was being provided. The central position of the multiple food placement positions are located where no food is present. Thus, the food items absorb microwaves from the magnetron at a reduced rate compared to when heating is applied in a localized manner to a position where food is present.

Also, if multiple items of food are placed and localized heating is applied to just one of the food items, there may be insufficient heating of the food items at other locations. Sequentially applying localized heat to each of the multiple food placement positions can lead to longer preparation time, and may not result in appropriate heating.

OBJECTS AND SUMMARY OF THE INVENTION

The object of the present invention is to overcome the above problems and to provide a microwave oven that can heat all food in an appropriate manner even when food items are simultaneously placed at multiple locations in a heating chamber.

According to one aspect of the present invention, a microwave oven includes: a heating chamber for holding food; a magnetron for producing microwaves to heat the food; an irradiation antenna guiding the microwaves from the magnetron to the heating chamber; and an antenna controller that, when the magnetron is performing a heating operation, controls the irradiation antenna in an alternating manner between a first mode wherein the microwaves from the magnetron are guided over an entirety of the heating chamber and a second mode wherein the microwaves are guided to a specific area in the heating chamber.

As a result, the microwave oven provides localized heat for a food item placed in a specific location in the heating chamber while also heating food items placed at other locations in the heating chamber.

Thus, if food items are placed at multiple locations in the heating chamber at the same time, the microwave oven can still heat all food items appropriately.

Also, it is preferable for the microwave oven of the present invention to further include a placement position determining module determining a placement position for a food item that is to be heated in a localized manner inside the heating chamber. The specific area is the placement position of the food item to be heated in a localized manner.

As a result, heating by the microwave oven is performed according to the locations where food is placed.

Also, it is preferable for the microwave oven of the present invention to further include a temperature detector detecting temperature at a plurality of locations in the heating chamber. The placement position determining module determines that the placement position of the food item to be heated in a localized manner is the location that has a maximum temperature increase value within a predetermined time when the magnetron is performing the heating operation and the irradiation antenna is being controlled in the first mode.

As a result, the position of the food for which localized heat is to be applied is determined without requiring the user to select which food item to be heated in a localized manner and does not require the user to enter the location of the food in the microwave oven.

Thus, the microwave oven is made easier to use.

Also, it is preferable for the microwave oven of the present invention to further include an antenna rotation module for rotating the irradiation antenna. The antenna control module controls the irradiation antenna in the first mode by rotating the antenna rotation module and in the second mode by stopping the irradiation antenna at a predetermined position which directs the irradiation toward a detected food item.

This allows the irradiation antenna to be controlled in the first mode and the second mode easily.

Also, it is preferable in the microwave oven of the present invention for the antenna controller to select between a full heating mode wherein an entirety of the heating chamber is heated by controlling the irradiation antenna in the first mode and a localized heating mode wherein localized heating of the specific location in the heating chamber is performed by alternately controlling the irradiation antenna between the first mode and the second mode.

As a result, heating is performed for the entire heating chamber or localized heating is performed for a specific location. Also, when a specific location is to be heated in a localized manner, food items placed in other locations are still heated appropriately.

Also, it is preferable for the microwave oven of the present invention to further include a temperature detector which detects temperatures at a plurality of locations in the heating chamber. The antenna controller determines whether to control the irradiation antenna using the full heating mode or the localized heating mode depending on a temperature increase value within a predetermined time of a location detected by the temperature detector as having a lowest temperature when the magnetron begins heating.

As a result, whether or not to provide control for localized heating is determined based on whether identical temperatures are detected within a region that is judged to be suited for localized heating.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6(A) is a plan drawing with the auxiliary antenna and the rotating antenna from the microwave oven of FIG. 1 in an overlapped state.

FIG. 6(B) is a cross section of a region F of FIG. 6(A)

DETAILED DESCRIPTION OF THE PREFERRED EMBODIMENTS

1. Structure of the Microwave Oven

Figure 1:
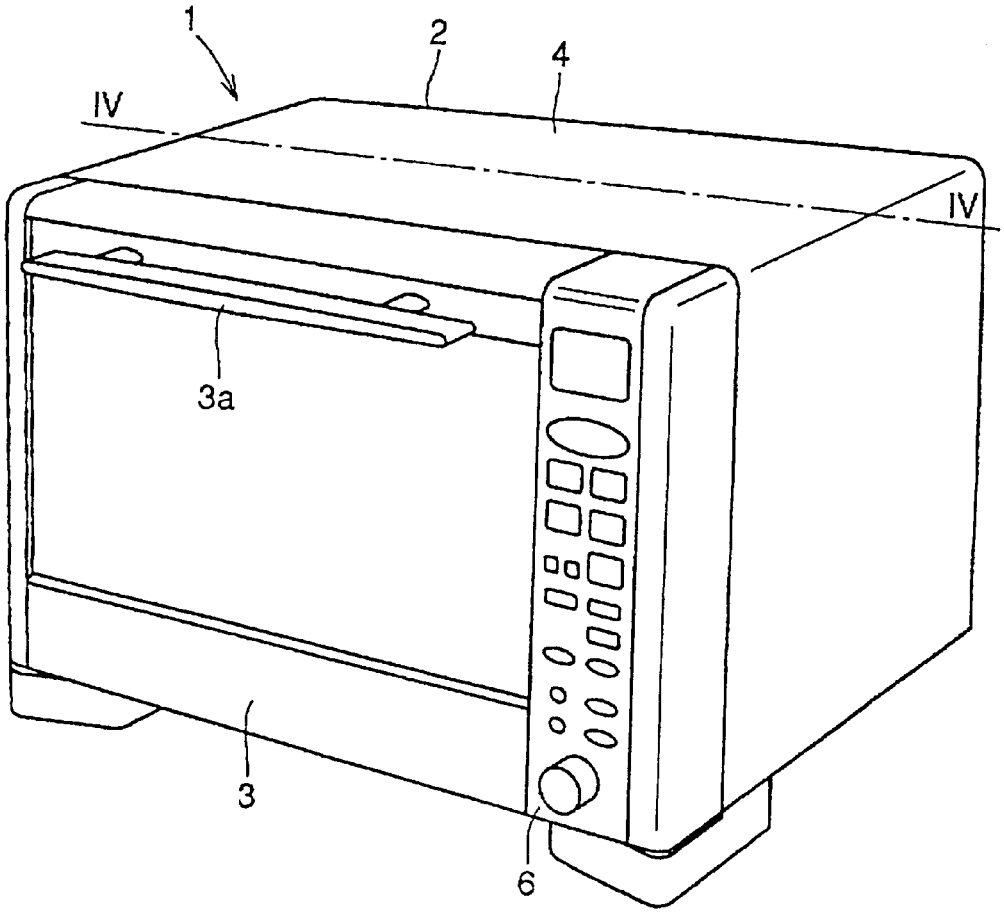
FIG. 1 is a perspective drawing of a microwave oven according to an embodiment of the present invention.

Referring to FIG. 1, a microwave oven 1 is formed essentially from a main unit 2 and a door 3. The main unit 2 is covered on the outside by an outer covering 4. An input panel 6 is disposed on the front of the main unit 2 to allow the user to enter various types of information in the microwave oven 1. Also, the main unit 2 is supported on a plurality of feet.

The door 3 is pivoted around its bottom end to permit it to open and close. A handle 3*a* is disposed at the upper part of the door 3.

Figure 2:
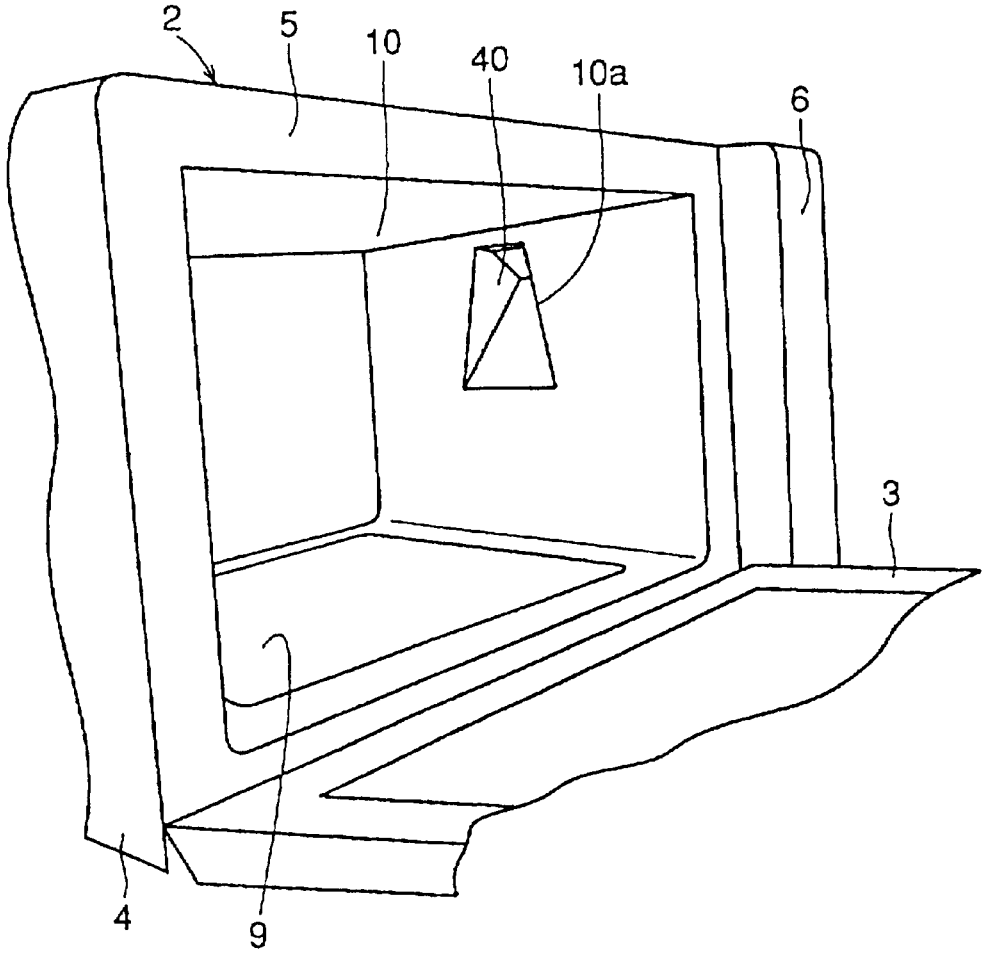
FIG. 2 is a perspective drawing of the microwave oven of FIG. 1 viewed through its opened door.

Referring to FIG. 2, a partial perspective drawing of the microwave oven 1 with the door 3 open reveals a main unit frame 5 is disposed inside the main unit 2. A heating chamber 10 is disposed inside the main unit frame 5. A hole 10*a* is formed on the upper part of the right side surface of the heating chamber 10. A detection path member 40 is connected to the hole 10*a* from the outside of the heating chamber 10. A bottom plate 9 closes the bottom surface of the heating chamber 10.

Figure 3:
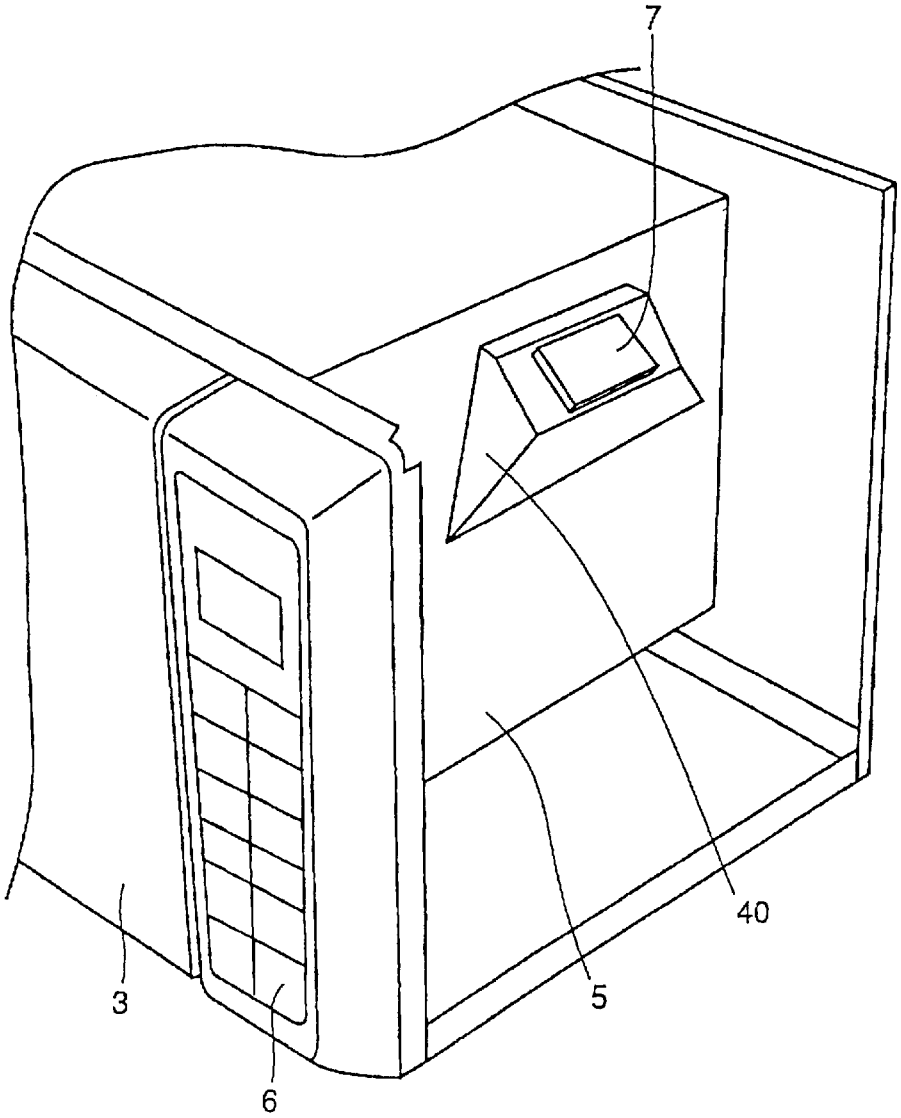
FIG. 3 is a perspective drawing of the microwave oven of FIG. 1 with the outer cover removed.
Figure 4:
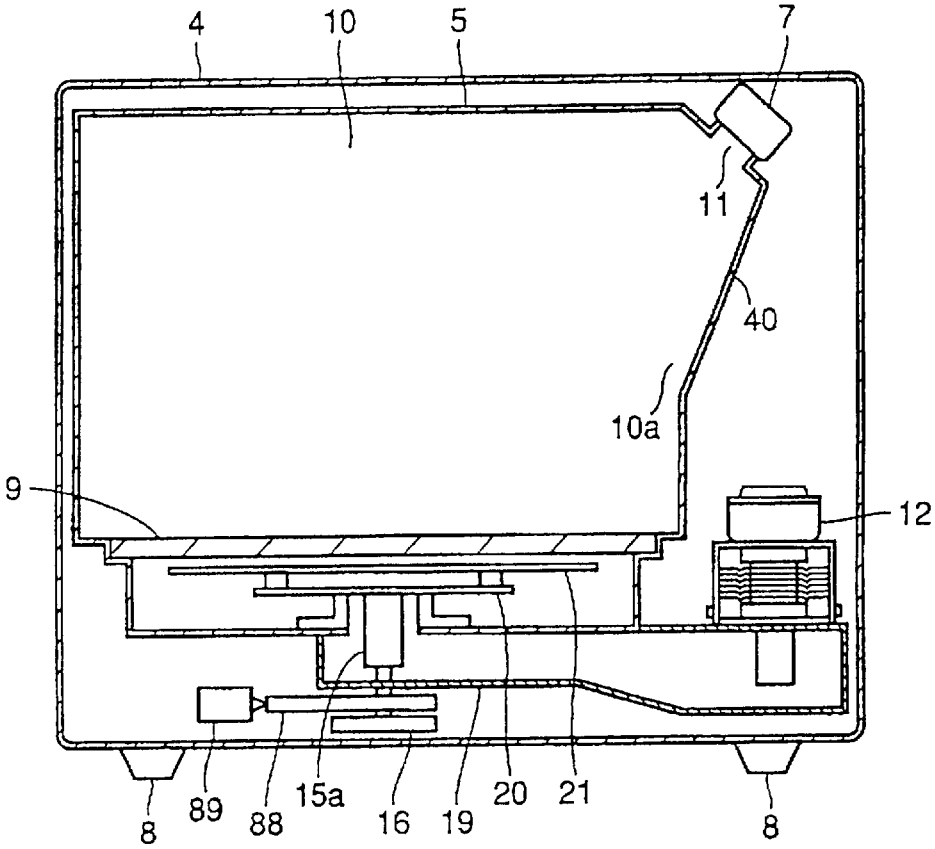
FIG. 4 is a cross-section drawing along the IV—IV line of the microwave oven of FIG. 1.

Referring to FIGS. 3 and 4, the microwave oven 1 with the outer covering 4 removed reveals a magnetron 12 mounted on the right side surface of the main unit frame 5 adjacent to the heating chamber 10. The box-like detection path member 40 connected to the hole 10*a* includes an opening. The opening is connected to the hole 10*a*. An infrared sensor 7 is attached at the bottom surface of the box shape of the detection path member 40. A detection window 11 is formed on the bottom surface of the box shape forming the detection path member 40. The infrared sensor 7 receives infrared waves from the heating chamber 10 via the detection window 11.

The magnetron 12 is disposed inside the outer covering 4 so that it is adjacent below and to the right of the heating chamber 10. A waveguide 19 is disposed below the heating chamber 10 to connect microwave radiation from the magnetron 12 to the bottom of the main unit frame 5. The waveguide 19 delivers microwave energy to the heating chamber 10.

A rotating antenna 20 is disposed between the bottom of the main unit frame 5 and the bottom plate 9. An antenna motor 16 is disposed below the waveguide 19. The rotating antenna 20 and the antenna motor 16 are connected via a shaft 15*a*. The antenna motor 16 is driven to rotate the rotating antenna 20.

Food is placed on the bottom plate 9 in the heating chamber 10. The microwaves from the magnetron 12 pass through the waveguide 19 and are then fed to the heating chamber 10 while being directed by the rotating antenna 20. The food on the bottom plate 9 is heated as a result.

A radiant heater unit, not shown in the figure, is disposed behind the heating chamber 10. The heater unit contains a heater (a heater 13 shown in FIG. 11) and a fan to efficiently send the heat generated by the heater into the heating chamber 10. A heater is also disposed above the heating chamber 10 to provide searing of the surface of the food.

An auxiliary antenna 21 is attached to the rotating antenna 20. The rotating antenna 20 and the auxiliary antenna 21 are flat. The auxiliary antenna 21 and the rotating antenna 20 are attached to each other by insulators to provide mutual insulation between the rotating antenna 20 and the auxiliary antenna 21. The rotating antenna 20 is attached to the upper end of the shaft 15*a*.

A switch 89 is attached adjacent the bottom of the rotating antenna 20. A cam 88, or any other suitable mechanism is attached for rotation with the rotating antenna 20. Each time the rotating antenna 20 makes one rotation, the cam 88, attached to the bottom of the rotating antenna 20, actuates the switch 89.

Figure 5:
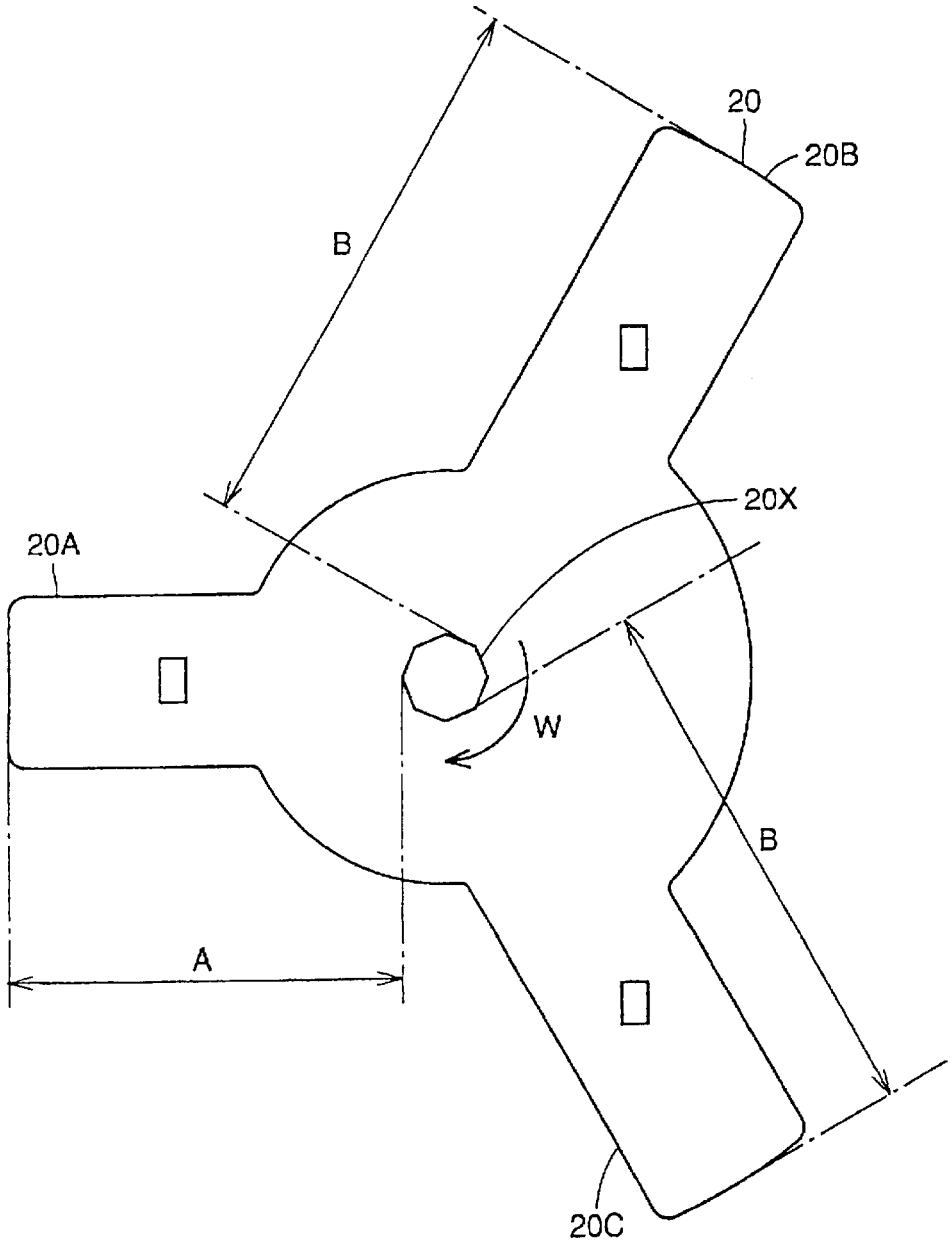
FIG. 5 is a plan drawing of the rotating antenna of the microwave oven of FIG. 1.

Referring to FIG. 5, the rotating antenna 20 is formed with a hole 20X, preferably hexagonal, at a central portion for connecting to the shaft 15*a*. The shaft 15*a* has a shape which mates with the shape of the hole 20X. The rotating antenna 20 is formed with sectoring 20A–20C extend radially centered on the hole 20X. The outer perimeter of the hole 20X is polygonal. A distance A of the end of the section 20A from the hole 20X is approximately 60 mm. A distance B of the end of the sections 20B and 20C from the hole 20X is approximately 80 mm. The distance A corresponds to approximately ½ the wavelength of the microwave oscillation from the magnetron 12.

The auxiliary antenna 21 is secured to the rotating antenna 20 so that it is rotated at the same rate as the rotating antenna 20. Slits 21A–21F near the section 20A of the auxiliary antenna 21 are oriented perpendicular to the primary propagation direction of the microwave (arrow E in FIG. 6(A)). As a result, microwaves are radiated forcefully from the slits 21A–21F. Microwaves are radiated especially forcefully from slits 21B, 21D, 21E, and 21F. In order to radiate microwaves efficiently from the slits 21B, 21D, 21E, and 21F, these slits are approximately 55 mm–60 mm lengthwise (approximately ½ wavelength at the microwave frequency).

In a quiescent condition, the rotating antenna 20 and the auxiliary antenna 21 are stopped with the slits 21A–21F are positioned toward the door 3 in the heating chamber 10. As a result, when these antennae are stopped and the magnetron 12 is active, food placed toward the front of the heating chamber 10 receive concentrated microwaves, thus allowing efficient heating. It is desirable to provide an indication in the vicinity of the slits 21A–21F (a region F in FIG. 6(A)) of the auxiliary antenna 21 by making the auxiliary antenna 21 visible from outside the heating chamber 10. Such visibility can be achieved, for example, by making the bottom plate 9 transparent. The indication may alternatively be in the form of the words "Power zone" or the like to indicate that concentrated heating takes place in this location. Alternatively, the surface for the corresponding section may be formed with a zigzag shape (i.e., as shown in the cross section in FIG. 6(B)).

A hole 21X is formed on the auxiliary antenna 21 at a region symmetrical to the region F.

The rotating antenna 20 is attached to the upper end of the shaft 15*a* by locking onto the upper end of the shaft 15*a*. The cross section of the locking section is polygonal rather than circular. Referring to FIG. 5, the cross section of the hole 20X is also formed with an octagonal shape. Since the cross-section where the shaft 15*a* is locked is polygonal, the rotating antenna 20 is prevented from slipping relative to the shaft 15*a* when the shaft 15*a* rotates so that the rotating antenna 20 turns in the direction of the arrow W. Thus, by controlling the rotation angle of the shaft 15*a*, the rotation angle of the rotating antenna 20 is reliably controlled.

2. The Field of View of the Infrared Sensor

Figure 7:
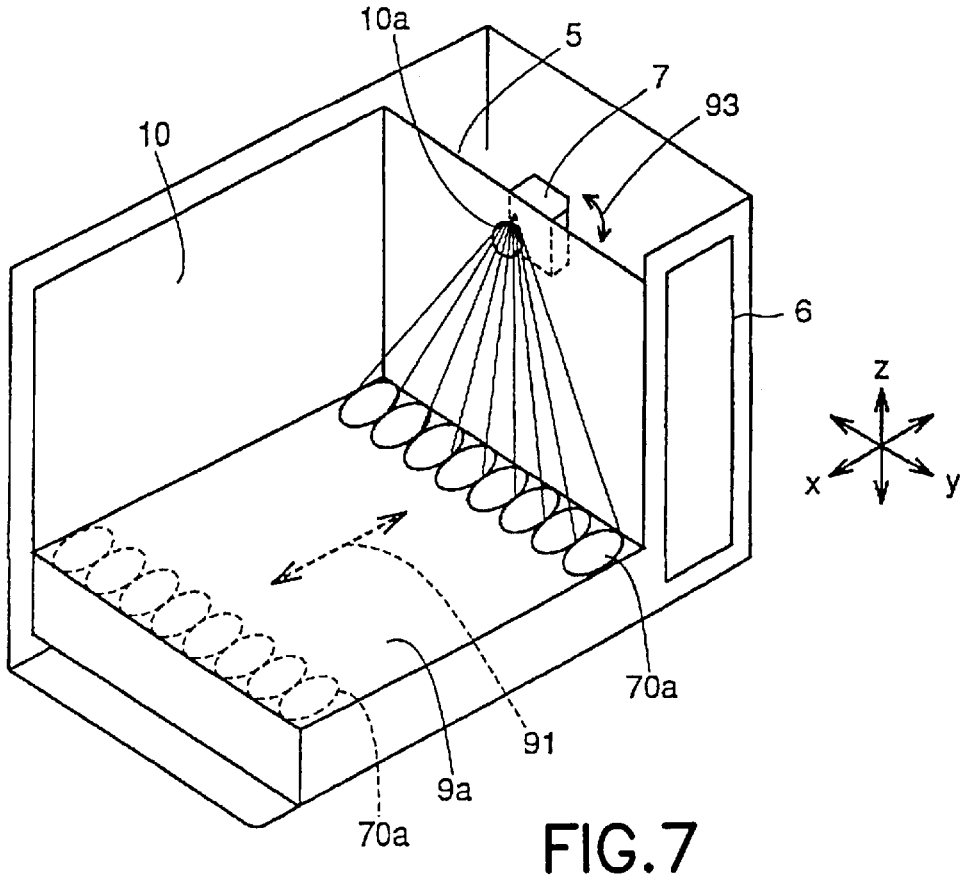
FIG. 7 is a drawing showing sample fields of view of an infrared sensor in the microwave oven of FIG. 1.

The infrared sensor 7 includes a plurality of infrared detection sensors 7*a* (infrared detection elements 7*a* in FIG. 11) to convert absorbed infrared rays to data. FIG. 7 shows the field of view of the infrared sensor 7 using a row of infrared detection elements extending along the depth axis of the heating chamber 10. In the following description, the field of view of the infrared sensor 7 refers to the combined fields of view of the plurality of infrared detection elements 7*a*. The lateral axis of the heating chamber 10 is defined as the x axis, the depth axis as the y axis and the height axis as the z axis. These three axes are perpendicular to one another.

The infrared sensor 7 is formed with eight infrared detection elements arranged along the y axis. Because the infrared sensor 7 includes eight infrared detection elements, eight fields of view 70*a* are simultaneously projected over a bottom surface 9*a* (including the bottom plate 9) on the indicated solid line along the y axis. The bottom surface 9*a* is covered by the eight fields of view 70*a* from one end of the y direction to the other end across a certain region along the x axis.

The microwave oven 1 includes a member (a moving section 72 described later, shown in FIG. 11) that moves the infrared sensor 7 in the direction of arrows 93. The arrows 93 indicates rotation along the x–z plane.

As the infrared sensor 7 is rotated in the direction indicated by the arrows 93, the positions of the fields of view projected on the bottom surface 9*a* move in the direction of an arrow 91 (along the x axis, laterally relative to the heating chamber 10). More specifically, the fields of view 70*a* move within the range from the fields of view 70*a* indicated by the solid lines to the fields of view 70*a* indicated by the dotted lines.

Figure 8:
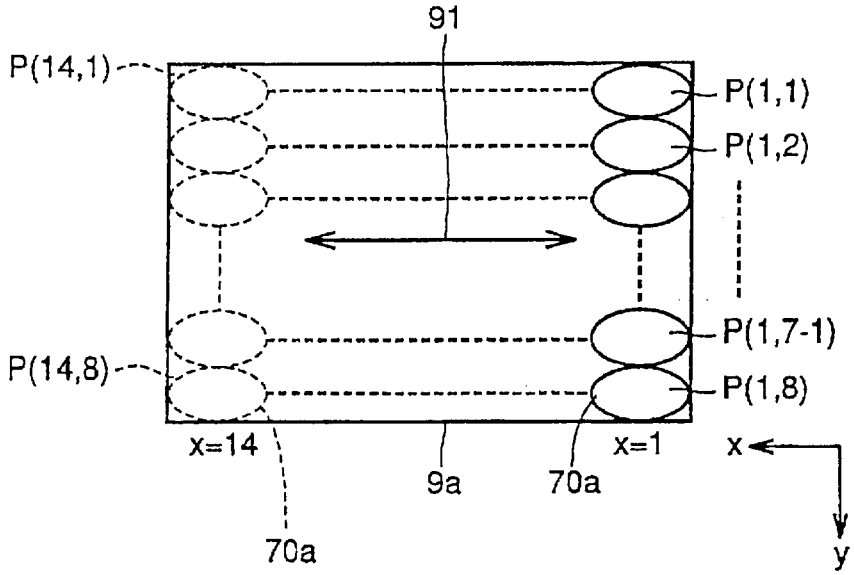
FIG. 8 is a simplified drawing showing the motion on the bottom surface of the heating chamber of the fields of view of the infrared detection elements of the example in FIG. 7.

Referring to FIG. 8, the fields of view 70*a* move as shown over the bottom surface 9*a*. The x axis and the y axis shown in FIG. 8 are the same as those shown in FIG. 7. There are 14 data points along the x axis on the bottom surface 9*a* and 8 fields of view providing points along they axis. Using a coordinate format where P(x, y) is the position of the fields of view 70*a* of the eight infrared detection elements on the bottom surface 9*a*, the fields of view move in the following ranges: P(1,1)–P(14,1), P(1,2)–P(14,2), P(1,3)–P(14,3), P(1, 4)–P(14,4), P(1,5) –P(14,5), P(1,6)–P(14,6), P(1,7)–P(14,7), P(1,8)–P(14,8).

Figure 9:
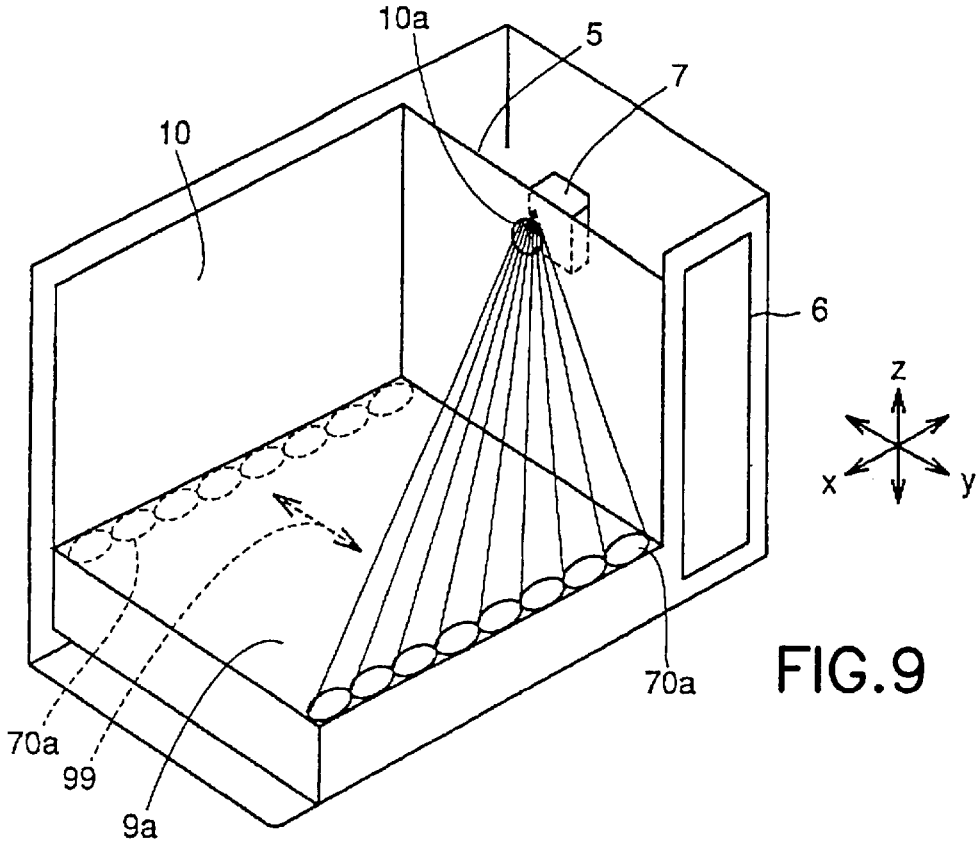
FIG. 9 is a drawing showing another example of the fields of view of the infrared sensor in the microwave oven of FIG. 1.

Referring to FIG. 9, a second embodiment of the invention forms the fields of view of the infrared sensor 7 with a row of infrared detection elements formed along the lateral direction of the heating chamber 10. The x axis, the y axis, and the z axis in FIG. 9 are the same as in FIG. 7.

When the infrared sensor 7 is moved by the moving section 72 (see FIG. 11, described later), the fields of view 70*a* projected on the bottom surface 9*a* move along the directions of the arrows 99 (along the y axis, i.e., depthwise relative to the heating chamber 10). More specifically, as the infrared sensor 7 is moved, the fields of view 70*a* move from the fields of view 70*a* indicated by the solid lines to the fields of view 70*a* indicated by the dotted lines.

Figure 10:
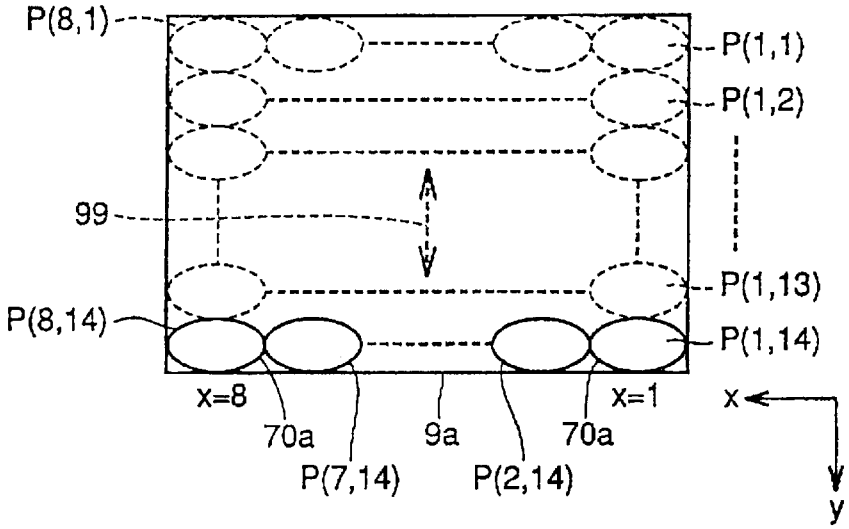
FIG. 10 is a simplified drawing showing the motion on the bottom surface of the heating chamber of the fields of view of the infrared detection elements.

Referring to FIG. 10, there is shown a simplified drawing showing how the fields of view 70*a* move over the bottom surface 9*a* for the microwave oven 1 when it uses the infrared sensor 7 shown in FIG. 9. The x axis and the y axis shown in FIG. 10 are the same as those shown in FIG. 9. There are 8 points along the x axis on the bottom surface 9*a* and 14 points along the y axis. Using a coordinate format where P(x, y) is the position of the fields of view 70*a* of the eight infrared detection elements on the bottom surface 9*a*, the fields of view move in the following ranges: P(1,1)–P(1, 14), P(2,1)–P(2, 14), P(2,1)–P(2, 14), P(3,1) –P(3, 14), P(4,1)–P(4, 14), P(5,1)–P(5, 14), P(6,1)–P(6, 14), P(7,1)–P (7, 14), P(8,1)–P(8, 14).

3. Control Block Diagram

Figure 11:
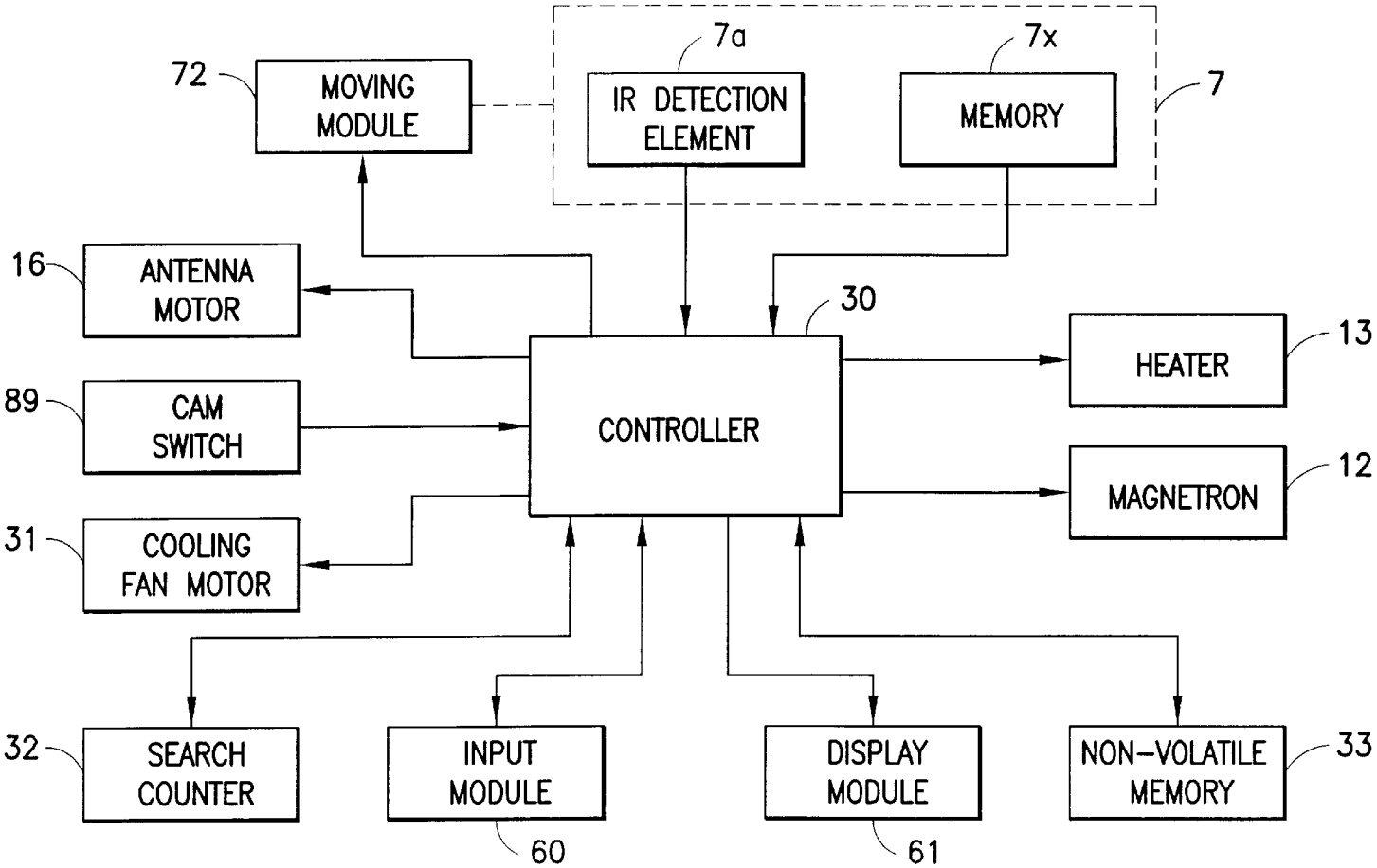
FIG. 11 is a control block diagram of the microwave oven of FIG. 1.

Referring to FIG. 11, there is shown a control block diagram of the microwave oven 1. The microwave oven 1 is equipped with a controller 30 providing overall control of the operations of the microwave oven 1. The controller 30 preferably contains a microprocessor.

The controller 30 receives information from an input module 60 and the infrared sensor 7. The input module 60 is a module that sends the information entered from the input panel 6 to the controller 30. Based on the received information and the like, the controller 30 controls the operations of the antenna motor 16, a cooling fan motor 31, a display module 61, the moving section 72, the magnetron 12, and the heater 13. The display module 61 is a display device, such as an LCD or LED, disposed in the input panel 6.

Figure 12:
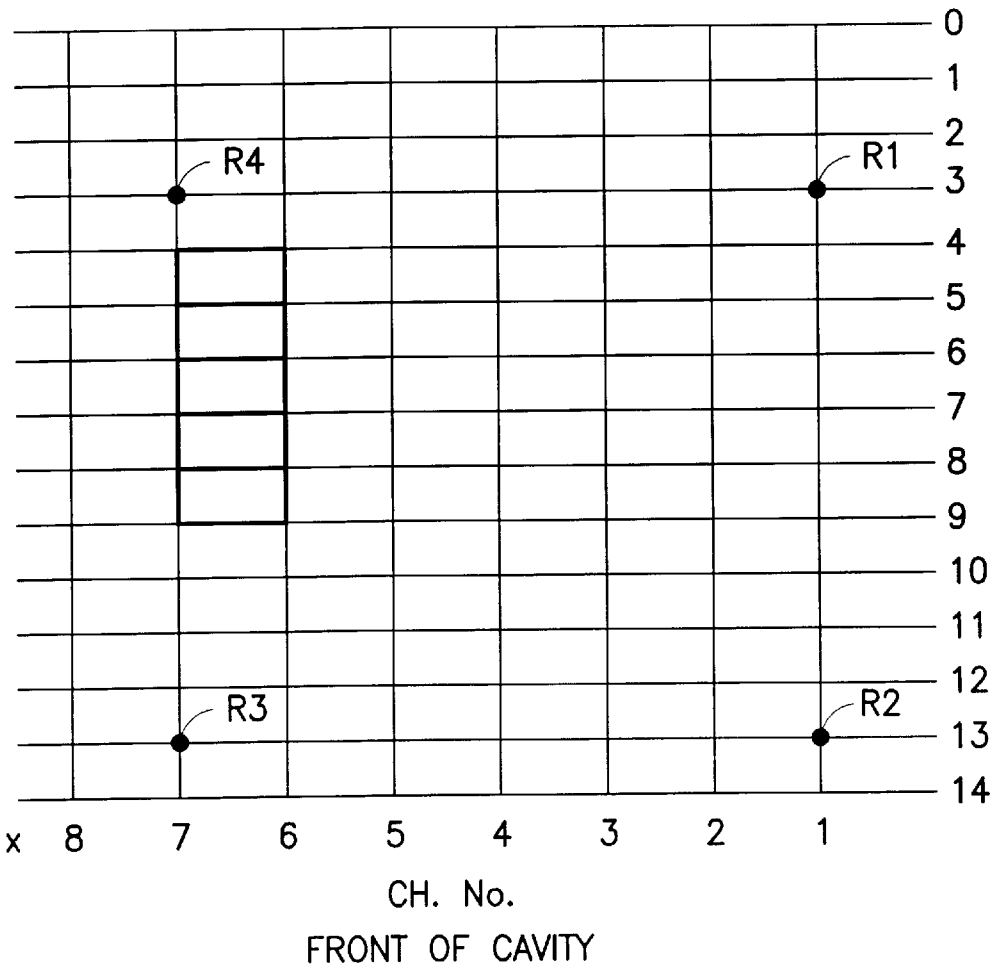
FIG. 12 is a drawing showing the coordinates defined on the bottom surface of the heating chamber in association with position information output from the infrared sensor to the controller in the microwave oven of FIG. 1.

The information sent from the infrared sensor 7 to the controller 30 is now described in detail. The infrared sensor 7 sends to the controller 30 position information in the heating chamber and temperature information corresponding to this position information. Transmission of the temperature information in the microwave oven 1 is described using FIG. 9 and FIG. 10. The infrared sensor 7 associates the position information along the lateral axis of the heating chamber 10 with the individual infrared detection elements and outputs the information from channels (CH) 1–8. CH1–CH8 correspond to the lateral coordinates (1–8) of the heating chamber 10. From each CH, the position information along the depth axis is output in terms of the coordinate values (1–14) defined for the depth axis. FIG. 12 shows how the coordinates are defined when the position information output from the infrared sensor 7 is shown relative to the bottom surface 9*a* of the heating chamber 10.

Referring to FIG. 12, the horizontal axis is defined as the x axis and the vertical axis is defined as the y axis. This x axis and y axis correspond to the axes in FIG. 9 and FIG. 10. CH1–8 are defined going from right to left of the heating chamber 10, and the y coordinates 1–14 are defined going from the back of the heating chamber 10 to the front. Referring to FIG. 12, points R1, R2, R3, and R4 are set up respectively at y coordinates 3 and 13 of CH3, and y coordinates 13 and 3 of CH7. These four points are positioned at the left and right corners of the front of the heating chamber 10 and the left and right corners at the back of the heating chamber 10. These four points are considered to be the positions where it is difficult to place food, and thus the least likely places at which food will be found. When the magnetron 12 begins heating operations, the temperatures detected at these four points are used as the temperature (tray temperature) of the bottom surface 9*a* where food is not placed. To derive the tray temperature, the maximum and minimum of these four temperatures are discarded and the two remaining values are averaged and used as the tray temperature.

Figure 13:
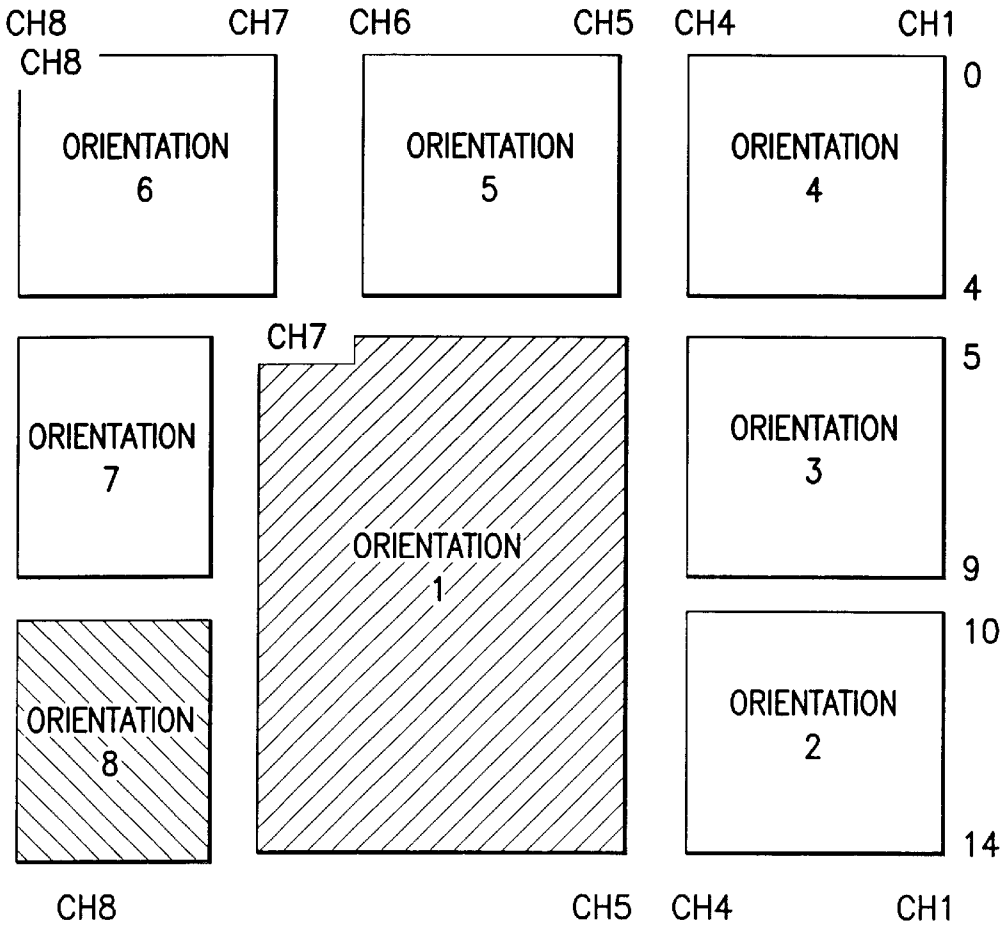
FIG. 13 is a drawing showing the coordinates defined in FIG. 12 divided into eight regions associated with the orientations of the auxiliary antenna.
Figure 14:
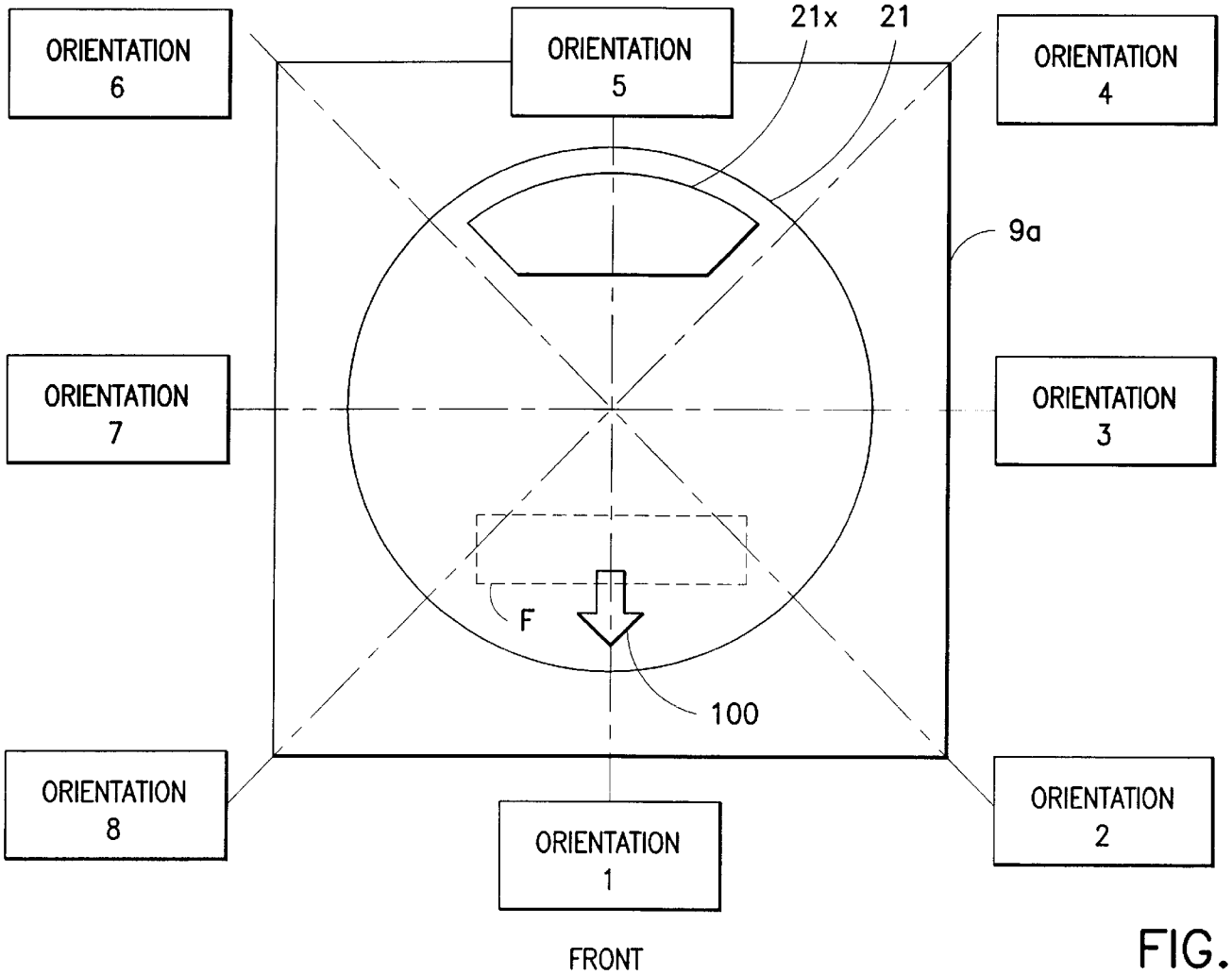
FIG. 14 is a drawing to which reference will be made in describing the orientation at which to stop the auxiliary antenna in the microwave oven of FIG. 1.

The controller 30, as described later, uses the detection output from the infrared sensor 7 to stop the rotation of the rotating antenna 20 so that the region F of the auxiliary antenna 21 is positioned directly under or near the position where it is assumed that food is placed. Referring to FIG. 13 and FIG. 14, the stopping position of the rotating antenna 20 is described in detail.

Referring to FIG. 13, the coordinates defined in FIG. 12 are shown as eight regions associated with the direction of the auxiliary antenna 21. Referring to FIG. 14, there is shown a drawing for the purpose of describing the orientation at which to stop the auxiliary antenna 21.

Referring to FIG. 14, in this embodiment, the direction of the auxiliary antenna 21 is initially assumed to be along an arrow 100. The arrow 100 points from the rotation center of the auxiliary antenna 21 toward the region F. Eight lines (dotted lines) extend radially from the rotation center of the auxiliary antenna 21. The eight lines are labeled orientation 1—orientation 8. FIG. 14 shows the auxiliary antenna 21 in orientation 1. Orientation 1 is an orientation extending from the center of the heating chamber 10 to the front.

Orientation 2 through orientation 8 are defined in order going counterclockwise from orientation 1. For example, orientation 5 extends from the center of the heating chamber 10 toward the rear, and orientation 7 extends from the center of the heating chamber 10 to the left.

Referring to FIG. 13, the coordinates of the bottom surface 9*a* are divided into eight regions corresponding to orientation 1 through orientation 8. The coordinate regions corresponding to orientation 1 through orientation 8 are shown in Table 1.

TABLE 1

| | Coordinates of regions | |
|---|---|---|
| | x coordinate | y coordinate |
| Orientation 1 | CH5–CH7 | 5–14 |
| Orientation 2 | CH1–CH4 | 10–14 |
| Orientation 3 | CH1–CH4 | 5–9 |
| Orientation 4 | CH1–CH4 | 0–4 |
| Orientation 5 | CH5–CH6 | 0–4 |
| Orientation 6 | CH7–CH8 | 0–4 |
| Orientation 7 | CH8 | 5–9 |
| Orientation 8 | CH8 | 10–14 |

Referring to Table 1 and FIG. 13, if food is determined to be placed at y coordinate 11 of CH6, this point belongs to "orientation 1". The microwave oven 1 stops the auxiliary antenna 21 in the direction of orientation 1 to begin heating operations in that direction.

As the orientation of the auxiliary antenna 21 changes, the position of the region F also changes. The region F is a region that receives microwave radiation more powerfully compared to other regions of the auxiliary antenna 21. Referring to FIG. 13, if the food placement position is detected on the bottom surface 9*a*, the stopping orientation of the auxiliary antenna 21 is determined so that the region F is located at that position. In other words, the stopping position for the auxiliary antenna 21 is determined so that the heating takes place most powerfully at the position where the food is assumed to be placed. The placement position of the food does not necessarily have to be detected by the microwave oven 1. For example, the user can enter the food placement position so that the stopping position of the auxiliary antenna 21 is determined based on the entered information and according to the relationship shown in FIG. 13.

The controller 30 also receives on/off information from the cam switch 90. Based on this, the stopping positions of the rotating antenna 20 and the auxiliary antenna 21 are controlled. This stopping position control is described in detail.

Referring to Table 2, there is shown the times required to reach orientation 1 through orientation 8 from the time the cam switch 89 is actuated.

TABLE 2

| | Time for the antenna motor to stop after the cam switch is actuated | |
|---|---|---|
| | 50 Hz | 60 Hz |
| Orientation 1 | 1.42 | 1.18 |
| Orientation 2 | 1.67 | 1.39 |
| Orientation 3 | 1.93 | 1.61 |
| Orientation 4 | 0.12 | 0.10 |
| Orientation 5 | 0.38 | 0.32 |
| Orientation 6 | 0.64 | 0.53 |
| Orientation 7 | 0.90 | 0.75 |
| Orientation 8 | 1.16 | 0.96 |

Referring to Table 2, for a 60 Hz power supply frequency, the controller 30 stops the antenna motor 16 1.18 seconds after the cam switch 89 is actuated in order to stop the auxiliary antenna 21 at orientation 1.

Thus, by stopping the antenna motor 16 according to the times after actuation of the cam switch 89, as shown in Table 2, the stopping positions of the auxiliary antenna 21 are controlled by the controller 30 for orientation 1 through orientation 8.

The controller 30 is also connected to a search counter 32. The search counter 32 counts the number of searches performed by the infrared sensor 7. The search count of the infrared sensor 7 refers to the number of times the temperature has been detected for the entire area of the bottom surface 9*a* of the heating chamber 10. Referring to FIG. 7 and FIG. 9, in this embodiment this count is the number of times the fields of view 70*a* move from the position indicated by the solid lines to the position indicated by the dotted lines or from the dotted lines to the solid lines.

The infrared sensor 7 is equipped with multiple infrared detection elements 7*a*. The infrared sensor 7 is also equipped with a memory 7*x* for storing data used to correct detection error in each lot. When power is first turned on, the controller 30 stores the correction data stored in the memory 7*x* in a non-volatile memory 33 located separately from the infrared sensor 7. As a result, the parts used in the memory 7*x* do not require high heat resistance even if the infrared sensor 7 is attached in a position that experiences relatively high temperatures. In other words, the memory 7*x* does not have to be heat-resistant and thus can be inexpensive. Thus, by having the controller 30 transfer the contents of the memory 7*x* to the non-volatile memory 33, the cost of the microwave oven 1 is reduced.

4. Operations Performed By The Microwave Oven

1) Standard Operations

Figure 15:
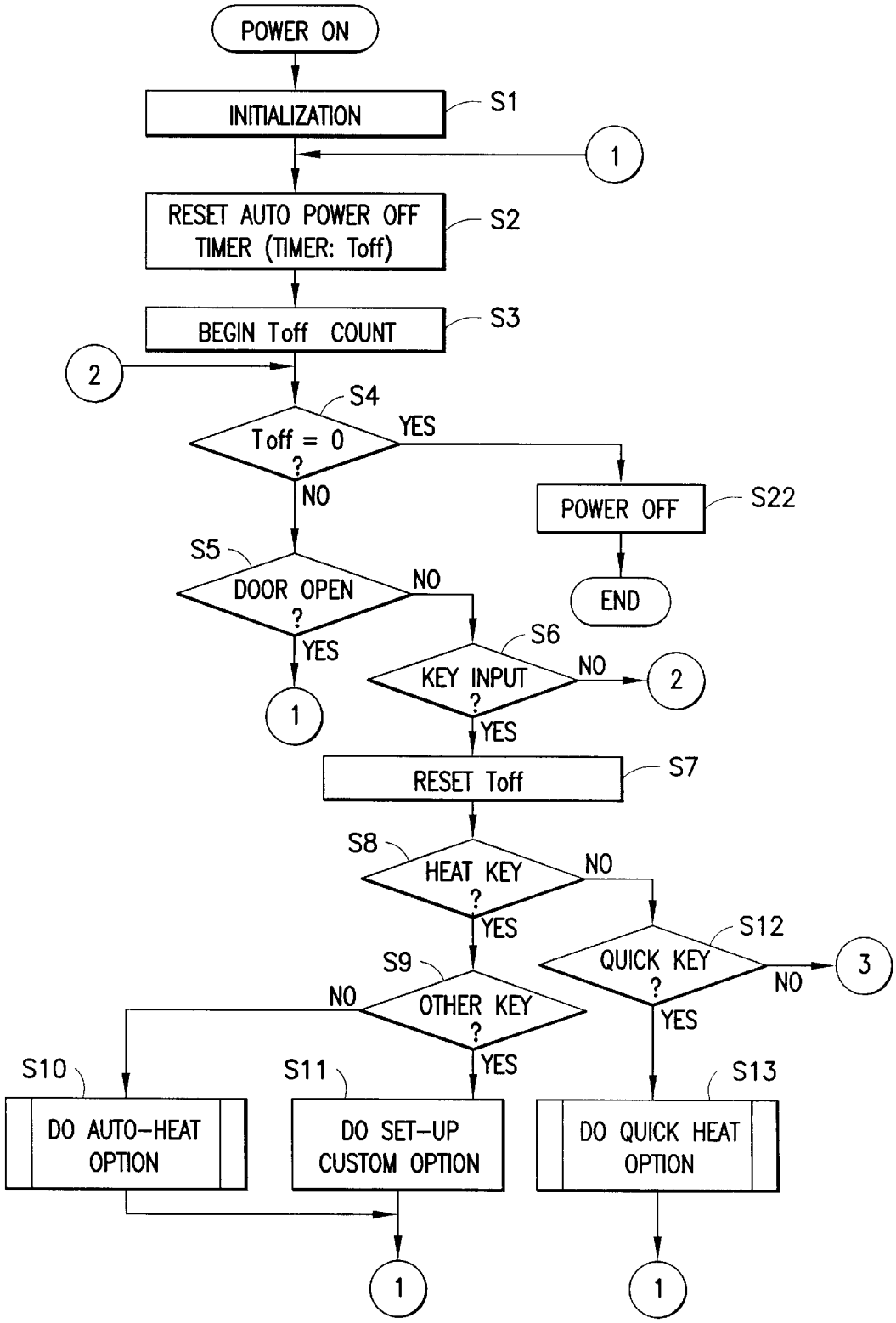
FIG. 15 is a flowchart showing the operations performed when power is turned on in the microwave oven of FIG. 1.
Figure 16:
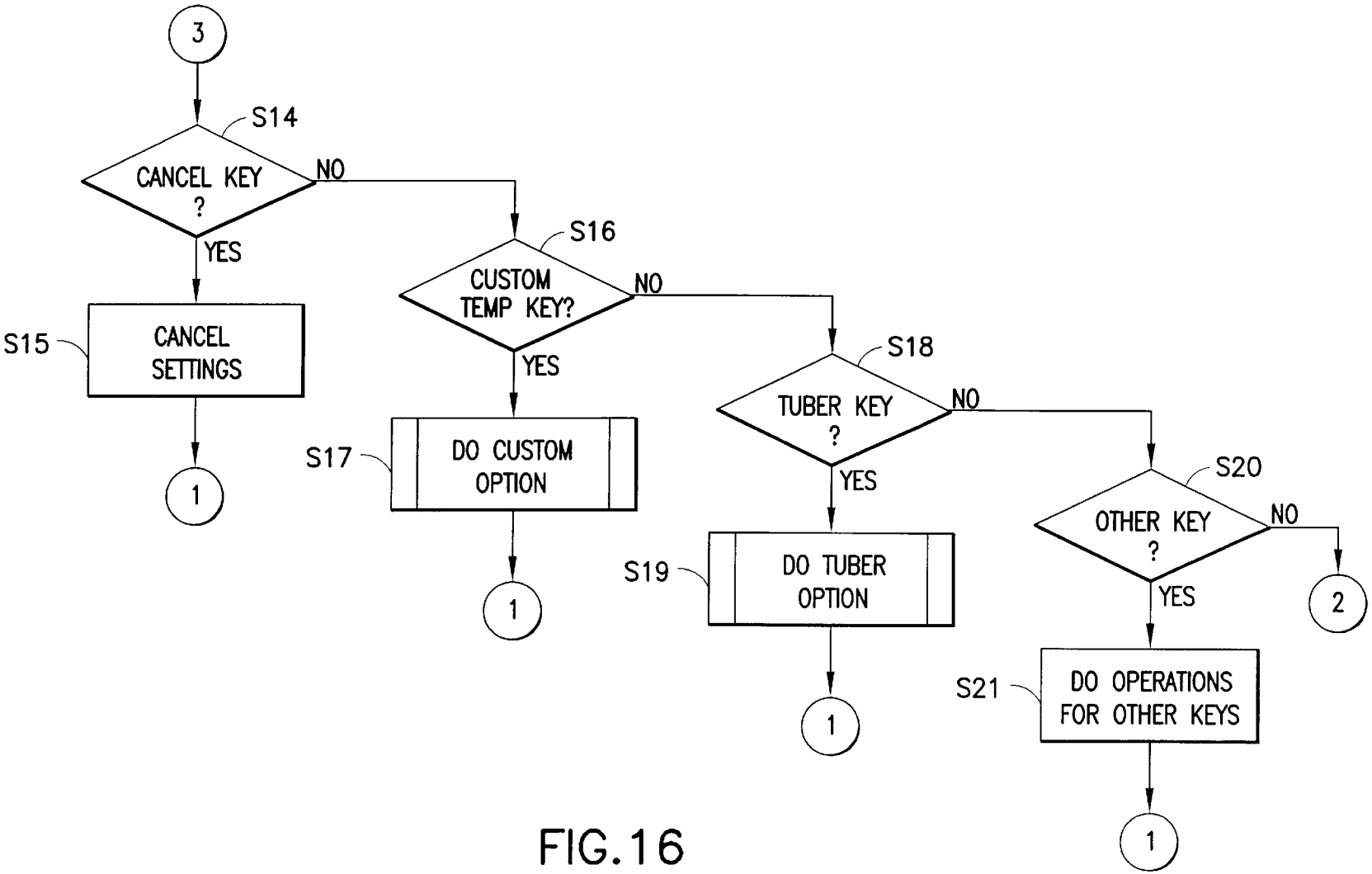
FIG. 16 is a continued flowchart showing the operations performed when power is turned on in the microwave oven of FIG. 1.

Next, the operations performed by the microwave oven 1 after power is applied are described using flowcharts. Referring to FIG. 15 and FIG. 16, there are shown flowcharts of operations performed by the microwave oven when power is turned on.

Initialization takes place at S1 when power to the microwave oven 1 is turned on. The first time the power is turned on for the microwave oven 1, the storage contents of the memory 7*x* is stored in the non-volatile memory 33 at S1 as described above. Power is turned on as a result of predetermined key operations on the input panel 6 or when the door 3 is opened from the closed state.

Next, at S2, a count value for an auto-poweroff timer is reset. The auto-poweroff timer is a timer used to count down periods during which no operation is performed on the microwave oven 1 and during which the microwave oven 1 performs no operations. When the timer is decremented to 0, the power to the microwave oven 1 is automatically turned off Next, at S3, the countdown of the Toff is started.

Next, at S4, the Toff count value is checked to see if it is 0. If so, power from the power supply to the microwave oven 1 is turned off at S22 and the operation is exited. If the counter has not reached 0, control proceeds to S5.

At S5, the door 3 is checked to see if it is open. If so, control returns to S2. In other words, the Toff is reset when the door 3 is opened. If the door is closed, control proceeds to S6.

S6 checks to see if an entry has been made to any of the keys on the input panel 6. If so, the Toff is reset at S7 and control proceeds to S8. Otherwise, control returns to S4.

The various keys described below are disposed on the input panel 6 and operations performed on these keys are transferred by the input module 60 to the controller 30.

S8 determines if the pressed key is the "Heat key". The "Heat key" is a key used when heating standard food. When this key is used, the microwave oven 1 detects the status of the food and automatically determines when to stop heating. If a "Heat key" operation is detected, control proceeds to S9. If another key operation was detected, control proceeds to S12.

S9 determines if heating condition settings were entered with other key operations after the "Heat key" was pressed. If so, control proceeds to S11 to perform operations associated with these other keys, and control then returns to S2. If there are no further heating condition settings, an evaluation is made to determine if an operation was entered to start heating. If so, control proceeds to S10.

At S10, once the operation associated with the automatic heating option is performed, control returns to S2. The operation associated with the automatic heating option is described later with reference to FIG. 17 and FIG. 18.

S12 determines if the entered key was the "Speed key". The "Speed key" is a key used to provide quick heating. If the "Speed key" was pressed, control proceeds to S13. If another key was pressed, control goes to S14.

At S13, the operations associated with the speed heating option are performed and control returns to S2. The operations associated with the speed heating option are described later with reference to FIG. 19.

S14 determines if the "Cancel key" was pressed. If so, S15 cancels the content that was set up through key entry and control returns to S2. If a different key was pressed, control proceeds to S16.

S16 determines if the "Custom temperature key" was pressed. The "Custom temperature key" is used to heat food to the entered temperature. If the "Custom temperature key" was pressed, control proceeds to S17. Otherwise, control proceeds to S18.

S18 determines if the "Tuber key" was pressed. The "Tuber key" is used to heat tubers such as potatoes. If the "Tuber key" was pressed, control proceeds to S19. Otherwise, control proceeds to S20.

S20 determines if the entered key was a key other than those checked for in steps up to S18. If so, control proceeds to S21, where operations associated with other key operations are performed, and control returns to S2. Otherwise, control goes to S4.

At S17, after performing the operations associated with the custom temperature option, control proceeds to S2. At S19, after performing the operations associated with the tuber option, control proceeds to S2. The operations associated with the custom temperature option and the tuber option are described later with reference to FIG. 20 and FIG. 21.

2) Operations Associated with the Automatic Heating Option

Figures 17, 17A, 17B:
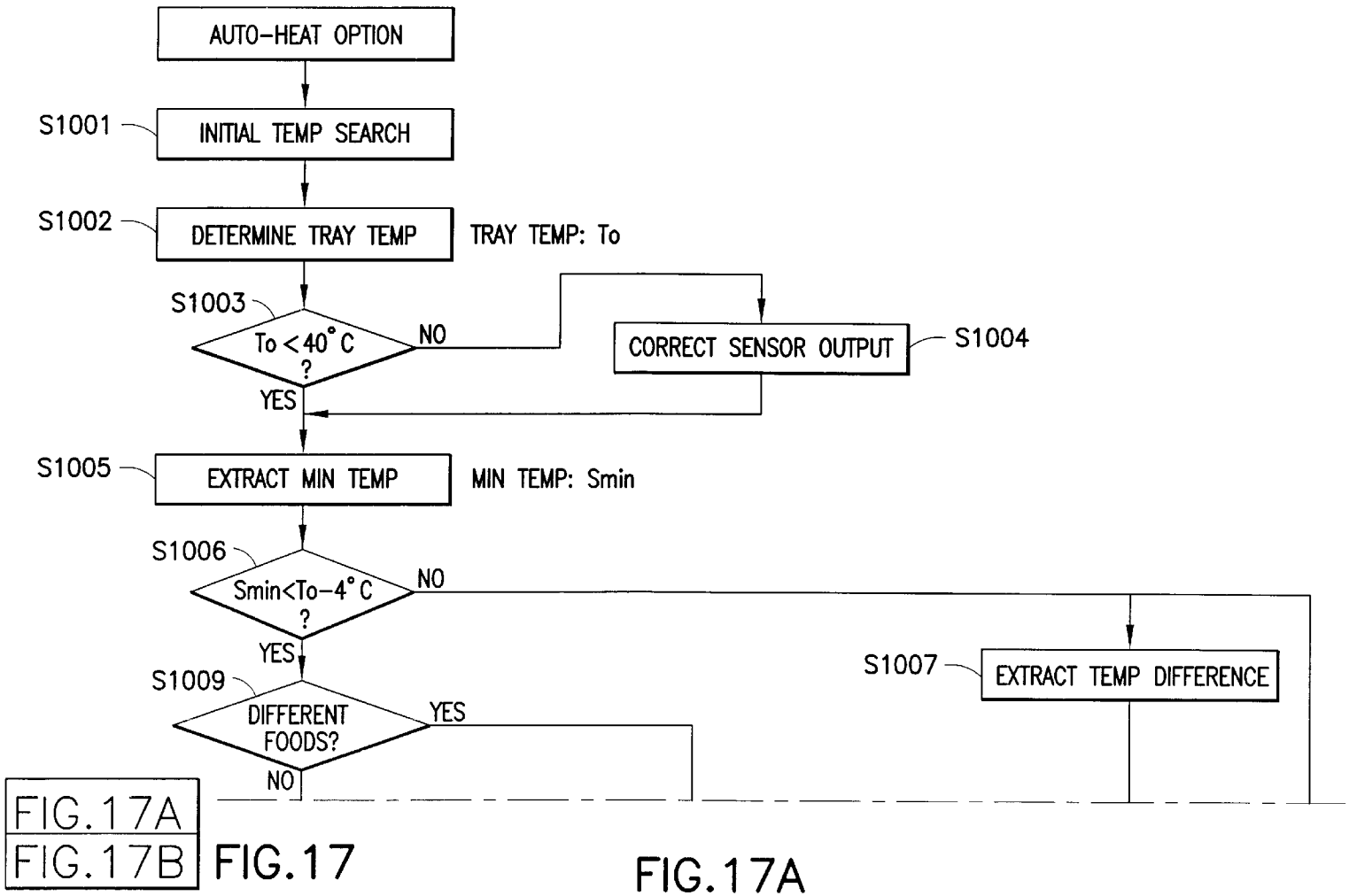
FIG. 17 consisting of FIG. 17A
FIG. 17B is a flowchart of a subroutine for the automatic heating option operations of FIG. 15.
Figure 17B:
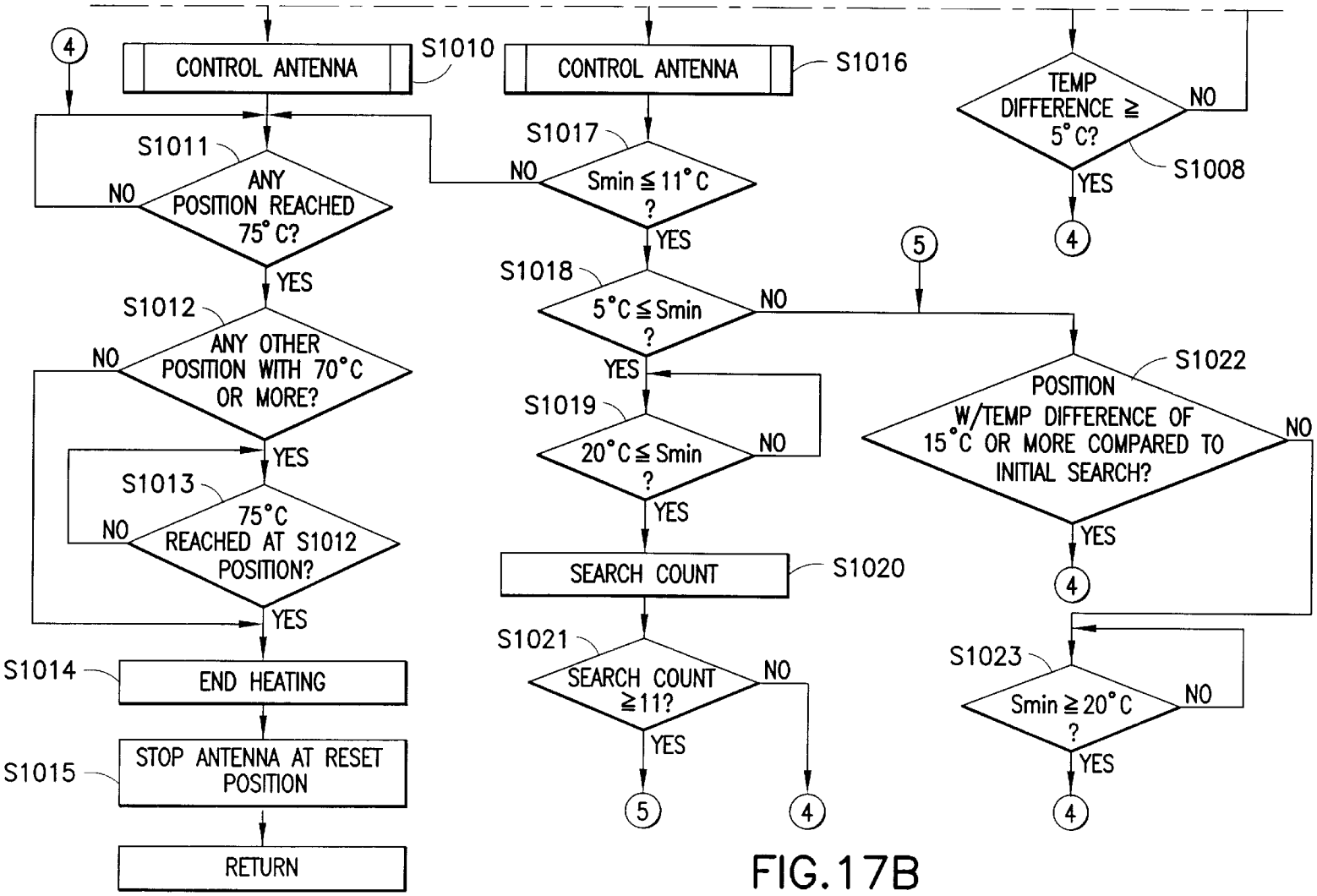

The operations associated with the automatic heating option are described. Referring to FIG. 17, the flowchart shows the subroutine for the automatic heating option operations (S10) from FIG. 15.

First, at S1001, the magnetron 12 starts heating operations and an initial temperature search is performed for the entire bottom surface 9*a* (y coordinates 1–14 for CH1–CH8). The heating operation is performed by the magnetron 12 while the rotating antenna 20 and the auxiliary antenna 21 are continuously rotated.

Next, at S1002, the temperatures for the four points R1 through R4 from FIG. 12 based on the detection output from S1001 are used to calculate a tray temperature T0. The highest temperature and the lowest temperature are discarded and the remaining two values are averaged to calculate the tray temperature T0.

Next, S1003 determines if T0 is at least 40 deg C. If not, control proceeds from S1004 to S1005. If the temperature is at least 40 deg C., control proceeds directly to S1005.

At S1004, correction is performed on the output values from the infrared sensor 7 and control proceeds to S1005.

More specifically, this correction involves subtracting from the detected temperature the amount that the tray temperature is believed to have offset the detection. The fields of view 70*a* of the infrared detection elements of the infrared sensor 7 include both the food and the bottom surface 9*a*. Thus, this correction minimizes the influence that the temperature of the heating chamber 10 itself has on the detection of the temperature of the food.

Another method for preventing the temperature of the heating chamber 10 itself from being detected as the food temperature is to use the tray temperature T0 as a temperature detection reference value, i.e., to have the infrared sensor 7 output the difference between the detected temperature and the tray temperature at each detection position in the heating chamber 10.

At S1005, the minimum temperature Smin is extracted from the temperature detected at S1001.

Next, S1006 determines whether Smin is lower than (T0–4 deg C.). If so, control proceeds to S1009. If Smin is at least (T0–4 deg C.), the operation proceeds to S1007.

S1007 extracts the temperature difference between the maximum temperature of the bottom surface 9*a* and the minimum temperature. S1008 determines whether this temperature difference is at least 5 deg C. The operations at S1007 and S1008 are continued until the temperature difference is found to be at least 5 deg C. If the temperature difference is found to be at least 5 deg C., the operation proceeds to S1011.

S1009 determines whether different types of food are placed in the heating chamber 10. The food types referred to here can include frozen food, cooled food, and room-temperature food. The presence of different types of food in the heating chamber 10 is determined using the sensed temperature distribution on the bottom surface 9*a*. If different types of food are found in the heating chamber 10, the operation proceeds to S1016. Otherwise, the operation proceeds to S1010.

Figures 18, 18A:
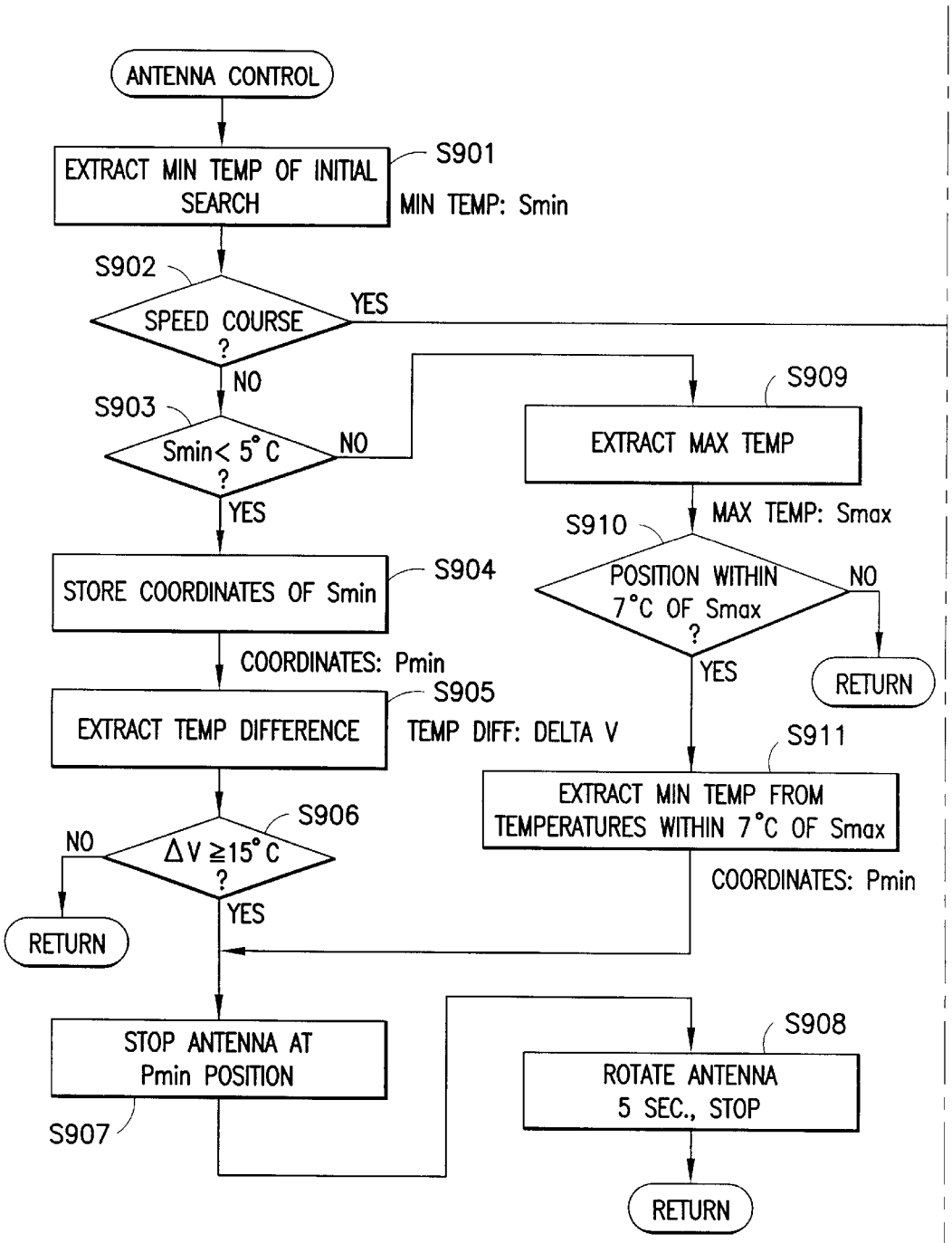
FIG. 18 consisting of FIGS. 18A and 18B is a flowchart of a subroutine for the antenna control operations of FIG. 17.
Figure 18B:
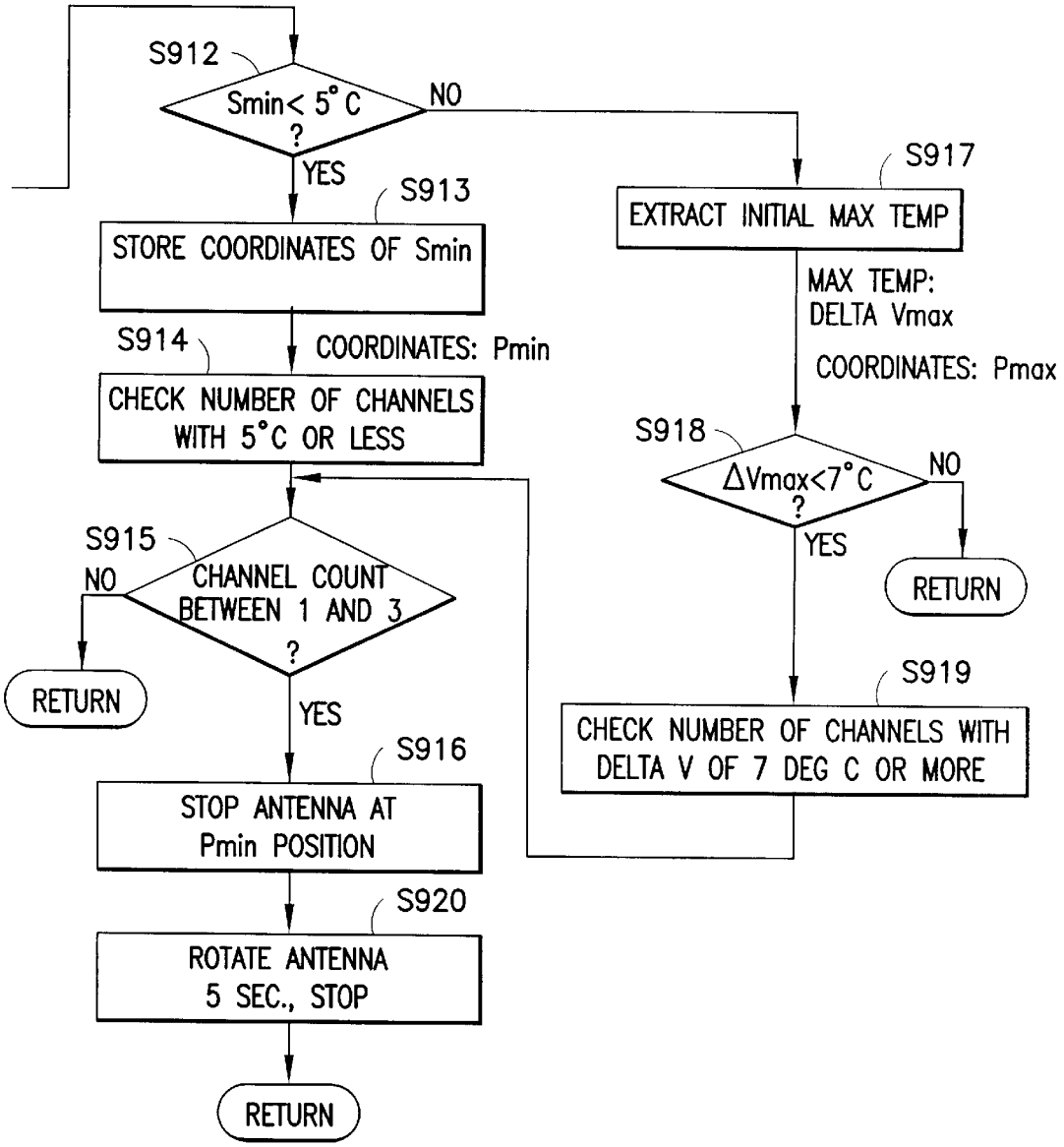

At S1010 and S1016, once the antenna control operation is executed, the operations proceed to S1011, S1017 respectively. Referring to FIG. 18, the antenna control operations will be described in detail.

FIG. 18 is a flowchart of the subroutine for the antenna control operation (S1010, S1016) from FIG. 17.

In the antenna control operation, S901 first extracts Smin in the same way as in S1005 (see FIG. 17).

Next, the operation currently being executed is checked to determine if it is the quick heating option. If so, the operation proceeds to S912. Otherwise, the operation proceeds to S903.

S903 determines if Smin is less than 5 deg C. If so, the operation proceeds to S904. Otherwise, the operation proceeds to S909.

At S904, the coordinates at which Smin was detected (Pmin: the channel and the y coordinate values) is stored in the controller 30.

Next, at S905, the temperature increase at Pmin within a certain time period is detected (detected temperature difference delta V). The certain time period can, for example, be a period during which the entire bottom surface 9*a* of the heating chamber 10 is detected a certain number of times. This can be measured using the output from the search counter 32. As a more specific example, the time for three scans of the temperature of the bottom surface 9*a*, approximately 5 seconds, can be used.

Next, S906 checks to determine whether delta V is at least 15 deg C. If so, the operation proceeds to S907. Otherwise, the subroutine returns.

At S907, the auxiliary antenna 21 is stopped at an orientation (see Table 1) corresponding to the position Pmin. At S908, the magnetron 12 performs heating operations continuously while every five seconds the auxiliary antenna 21 switches between being stopped at the orientation from S907 and having rotation resumed. The subroutine then returns. As a result, the auxiliary antenna 21 is stopped to provide concentrated heating for the low-temperature food in the heating chamber 10 while also allowing the auxiliary antenna 21 to rotate so that the entire heating chamber 10 is evenly heated. If there are multiple Pmin points, Pmin is set to the central position of the multiple Pmin points and the operation is continued.

The status switching interval of five seconds is set as an integer multiple of the time it takes to perform a temperature scan of the entire bottom surface 9*a*. In other words, the control timing for the elements in the microwave oven 1 is synchronized with the timing for the completion of a temperature scan for the entire heating chamber 10 by the infrared sensor 7. As a result, changes in the heating conditions for the food in the heating chamber 10 is prevented during the intervals for which the search counter 32 counts up by one, i.e., the intervals during which the fields of view 70*a* move once from the dotted line position to the solid line position or from the solid line position to the dotted line position. Thus, temperature detection for the heating chamber 10 takes place under consistent conditions during a single count of the search counter 32. Referring to FIG. 7 and FIG. 9, the manner in which the fields of view 70*a* move just once from the dotted line to the solid line or the solid line to the dotted line is referred to as the search pattern of the infrared sensor 7 for the entire heating chamber 10.

Thus, in this embodiment, the timing at which the control format for the elements associated with heating operations changes is synchronized with the starting or ending of a search pattern for the entire heating chamber 10 by the infrared sensor 7. The elements associated with heating operations include the magnetron 12, the rotating antenna 20, and the auxiliary antenna 21.

If S906 determines that delta V is less than 15 deg C., the auxiliary antenna 21 is left rotating and the subroutine returns. This is because if delta V is determined to be less than 15 deg C., the foot item is assumed to be relatively large, indicating that there is no need to fix the orientation of the auxiliary antenna 21 to provide localized heating.

S909 extracts the maximum temperature Smax of the bottom surface 9*a*.

Next, S910 determines if a position with a temperature within 7 deg C. of Smax was detected on the bottom surface 9*a*. If no such position was found, the subroutine returns. Otherwise, the operation proceeds to S911. In this evaluation, the channels adjacent to the channel where Smax was detected are excluded.

S911 extracts the minimum temperature of the positions at which temperatures within 7 deg C. of Smax were detected. The position at which the minimum temperature was detected is set up as Pmin and the operation proceeds to S907.

In the operations at S909 through S911, if multiple food items are placed in the heating chamber 10, S910 detects the positions of the food items that are least easily heated, up to the second most easily heated food item. Of these, concentrated heating is performed on the position with the lowest degree of heat in S911, S907, and S908. The reason the evaluation at S910 is done within 7 deg C. of Smax is so that the tray temperature is not included in the position temperatures. If the temperature difference from Smax exceeds 7 deg C., it is likely that the temperature is the tray temperature. The 7 deg C. value is an example, and the temperature range for which evaluation is to be performed can vary, e.g., according to the shape of the microwave oven 1.

S912 determines whether Smin extracted at S901 is less than 5 deg C. If so, the operation proceeds to S913. Otherwise, the operation proceeds to S917.

At S913, the coordinates of the position at which Smin was detected are stored in the controller 30.

The temperature detection for the heating chamber 10 includes CH1 through Ch8. S914 checks the number of channels in which a temperature of 5 deg C. was detected at least once for the y coordinates 1–14.

S915 determines if the number of channels found at S914 is between 1 and 3. If so, the operation proceeds to S916. Otherwise, the subroutine immediately returns.

As in S907, S916 stops the auxiliary antenna 21 at the orientation corresponding to the position of Pmin (see Table 1). Then, at S920, the magnetron 12 performs heating operations continuously while every five seconds the auxiliary antenna 21 switches between being stopped (S916) and having rotation resumed. The subroutine then returns.

Thus, the heating operations performed at S915, S916, and S920, including localized heating of specific areas in the heating chamber 10, are performed only if between one and three CH are detected with temperatures of 5 deg C. or less similar to Smin when S913–S916 and S920 were executed.

At S917, the current detected temperature is compared with the temperature at the start of the heating operation as detected at S1001 (see FIG. 17), and the coordinates Pmax for the location with the largest temperature increase and the temperature increase delta Vmax are extracted.

Next, S918 determines whether delta Vmax is less than 7 deg C. If so, the operation proceeds to S919. Otherwise, the subroutine immediately returns.

As in S917, S919 compares detected temperatures to calculate the temperature increases for each position. Then, the number of channels containing temperature increases of at least 7 deg C. are calculated. If, for example, CH3 and CH4 contained positions with temperature increases of at least 7 deg C., a channel count of "2" is calculated.

Next, S915 determines if the channel count calculated at S919 is between 1 and 3. Depending on the result, the subroutine returns immediately or the operation proceeds to S916.

Referring to FIG. 17, S1017 determines whether Smin is 11 deg C. or less. If so, the operation proceeds to S1018. Otherwise, the operation proceeds to S1011.

S1018 determines if Smin is at least 5 deg C. If so, the operation proceeds to S1019. Otherwise, the operation proceeds to S1022.

S1019 waits for Smin to reach 20 deg C., and the operation then proceeds to S1020.

At S1020, the value of the search counter 32 is checked. S1021 determines whether the counter value is at least 11. If so, the operation proceeds to S1022. Otherwise, the operation proceeds to S1011.

S1022 determines whether the current temperature detection results for the entire heating chamber 10 contain a position where the temperature has increased at least 15 deg C. compared to the temperature detection performed at S1001. If so, the operation proceeds to S1011. Otherwise, the operation proceeds to S1023.

S1023 waits for Smin to reach 20 deg C., and then the operation proceeds to S1011.

S1011 waits for any position on the bottom surface 9*a* to reach 75 deg C., and then the operation proceeds to S1012. In this case, 75 deg C. is the temperature at which to stop heating in the automatic heating option, i.e., food is heated to 75 deg C. in this option.

S1012 determines whether where there is a position different from the one detected at S1011 where a temperature of at least 70 deg C. is detected. If so, the operation proceeds to S1013. Otherwise, the operation proceeds to S1014.

S1013 waits for the detected temperature at the position detected at S1012 to reach 75 deg C. Then the operation proceeds to S1014.

At S1014, the heating operation performed by the magnetron 12 is stopped. At S1015, the auxiliary antenna 21 is stopped at "orientation 1" (the reset position), and the subroutine returns.

In the operations performed in S1011 through S1014, when the temperature of any position in the heating chamber 10 reaches 75 deg C. and the heating of the food at that position is considered to be completed, the other positions are checked for temperatures of at least 70 deg C. If such a position is found, the operation waits for the temperature of that position to reach at least 75 deg C., and then the heating operation is stopped. As a result, even if multiple food items are placed in the heating chamber 10, the time at which to stop the heating operation is determined in an appropriate manner so that all food items are heated.

In the operation at S1012, all positions other than the one detected at S1011 were used. However, it is also possible to exclude the channels for the positions detected by S1011 so that the same food item as the one detected at S1011 is not used again.

3) Operations Associated with the Quick Heating Option

Figure 19:
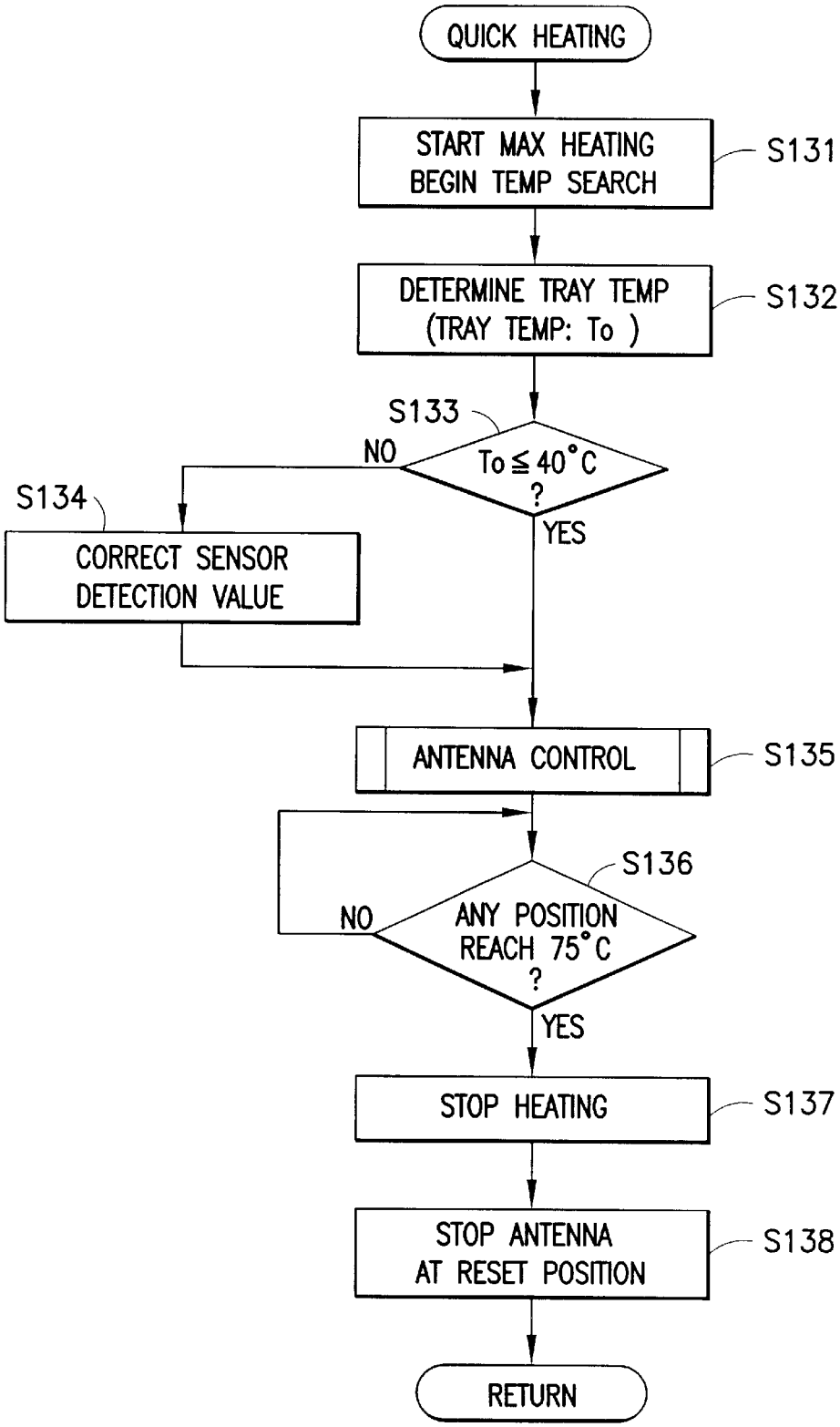
FIG. 19 is a flowchart of a subroutine for the quick heating option operations of FIG. 15.

The operations associated with the quick heating option are described. FIG. 19 is a flowchart of a subroutine of the quick heating option operation (S13) from FIG. 15.

At S131, the magnetron 12 begins heating operations at maximum output, the auxiliary antenna 21 is rotated, and temperature detection for the entire bottom surface 9*a* is started. Next, at S132, the tray temperature T0 is determined in the same manner as in S1002 (see FIG. 17).

Next, S133 determines whether T0 is 40 deg C. or less. If so, the operation proceeds to S135. Otherwise, at S134, correction of the detection output from the infrared sensor 7 is performed in the same manner as in S1004 (see FIG. 17). The operation then proceeds to S135.

At S135, the antenna control operation described using FIG. 18 is performed.

When antenna control operation is performed in the quick heating option subroutine, the operations at S912 through S920 perform the following operations. Based on the size of the area in which food is believed to be present (the number of channels calculated in S914 or S919), an evaluation is made (S915) on whether or not to perform heating control operations including concentrated heating of the area where the food is assumed to be placed (S920).

Next, S136 waits for the temperature at any position to reach 75 deg C., and the operation proceeds to S137.

At S137, the heating operation performed by the magnetron 12 is stopped. Next, S138 stops the rotation of the auxiliary antenna 21 at the reset position.

4) Operations Associated with the Custom Heating Option

Figures 20, 20A, 20B:
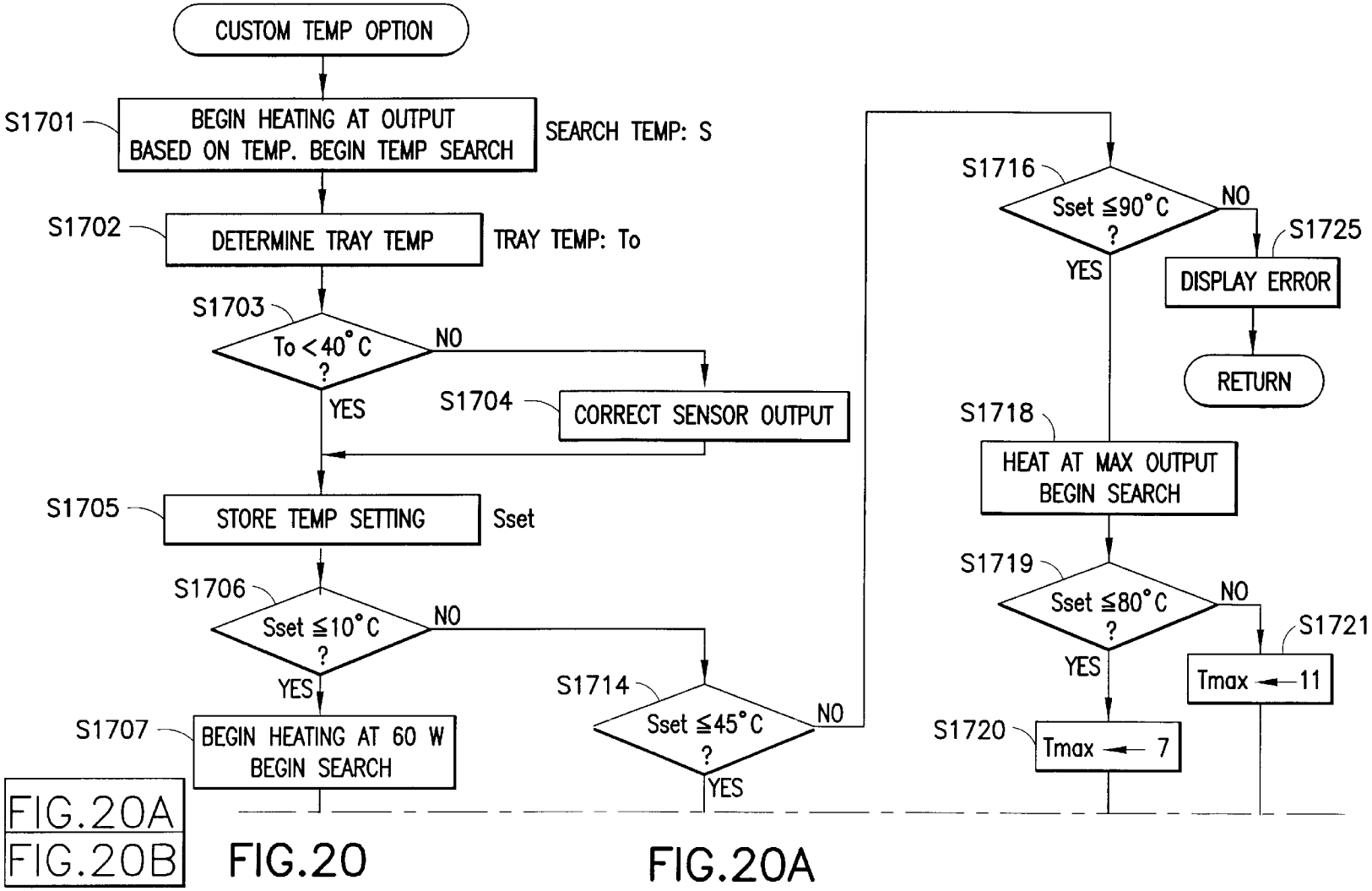
FIG. 20 consisting of FIG. 20A
FIG. 20B is a flowchart of a subroutine for the custom heating option operations of FIG. 15.
Figure 20B:
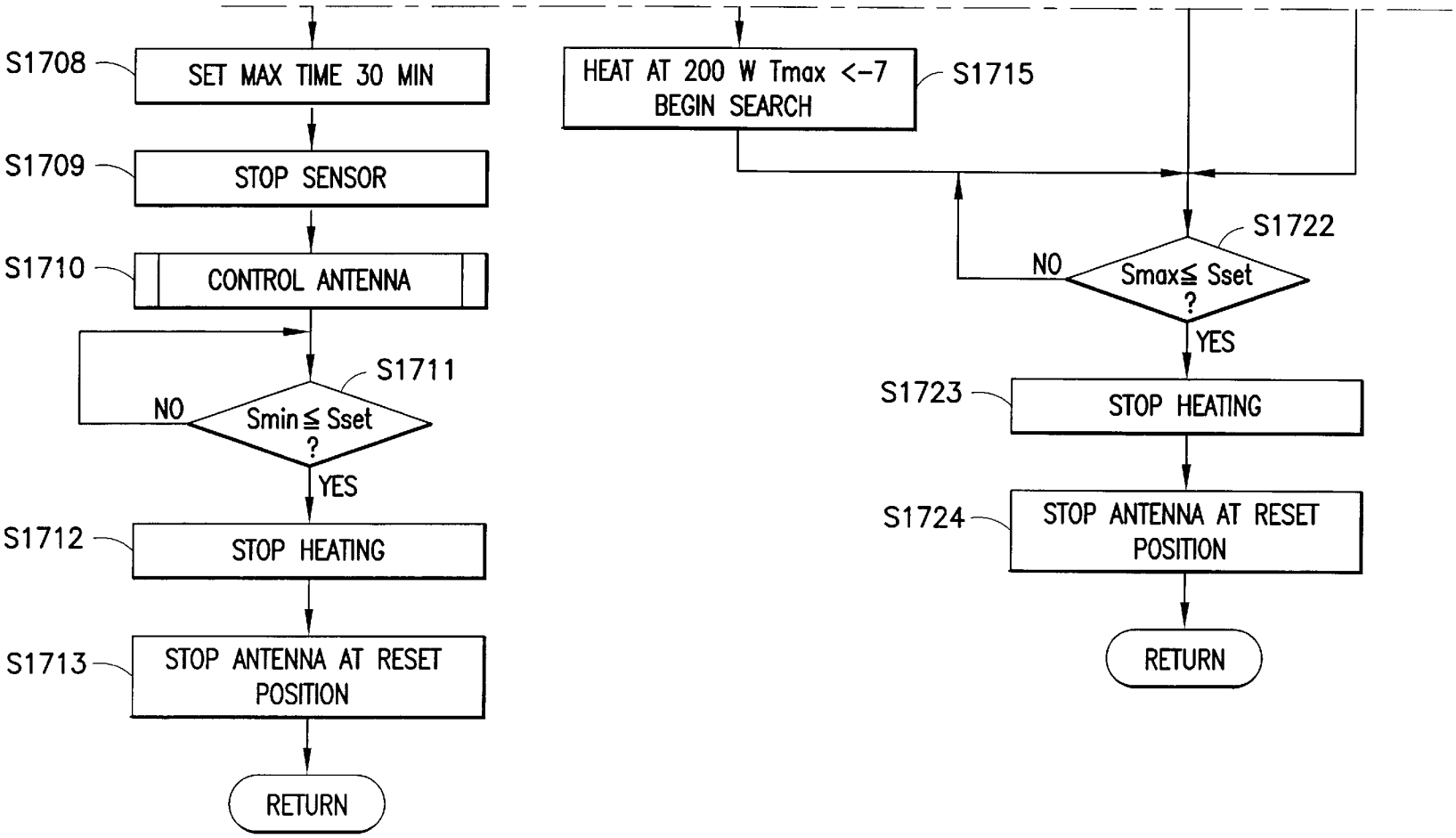

The operations associated with the custom heating option are described. FIG. 20 is a flowchart of the subroutine for the custom temperature option operations (S17) from FIG. 16.

First, at S1701, heating is begun at maximum output, the auxiliary antenna 21 is rotated, and temperature detection for the entire bottom surface 9*a* is begun. Next, at S1702, the tray temperature T0 is determined in the same manner as in S1002 (see FIG. 17).

Next, S1703 determines whether T0 is less than 40 deg C. If so, the operation proceeds to S1705. Otherwise, at S1704, correction is applied to the detection output from the infrared sensor 7 in the same manner as in S1004 (see FIG. 17). Then, the operation proceeds to S1705.

At S1705, the temperature entered by the user (temperature setting: Sset) is stored in the controller 30.

Next, S1706 determines if Sset is 10 deg C. or less. If so, the operation proceeds to S1707. Otherwise, the operation proceeds to S1714.

At S1707, the heat output from the magnetron 12 is changed to 60 W and temperature detection of the heating chamber 10 is continued. It is preferable for the heat output from the magnetron 12 to be changed to 60 W when a search pattern for the entire heating chamber 10 has been completed. Also, a heat output of 60 W is a relatively low output compared to the maximum output of the magnetron 12. For example, if the heating operation for frozen food or the like is to be stopped after it has been heated to a temperature of 10 deg C. or less, the microwave oven 1 lowers the output from the magnetron 12 and performs the heating operation.

Next, S1708 sets the maximum heating time Tmax to 30 minutes. As a result, the heating operation will stop after thirty minutes have elapsed even if the infrared sensor 7 does not detect Sset in the heating chamber 10.

Next, at S1709, the infrared sensor 7 is fixed so that the fields of view 70*a* are positioned at the position where the minimum temperature Smin was detected at S1701.

Next, at S1710, the antenna control operation described using FIG. 18 is executed.

Next, S1711 waits for Smin to reach Sset and then the operation proceeds to S1712. If the time set in Tmax has elapsed from the starting time before Smin reaches Sset, the operation proceeds to S1712 without waiting for Smin to reach Sset.

At S1713, the rotation of the auxiliary antenna 21 is stopped and the subroutine returns.

S1714 determines whether Sset is 45 deg C. or lower. If so, the operation proceeds to S1715.Otherwise, the operation proceeds to S1716.

At S1715, the output from the magnetron 12 is changed to 200 W, the Tmax described above is set to 7 minutes, a search pattern for the entire heating chamber 10 is begun, and the operation proceeds to S1722. It is preferable for the change in output and the setting of Tmax at S1715 to be synchronized with the start of a search pattern.

S1716 determines whether Sset is 90 deg C. or less. If so, the operation proceeds to S1718. Otherwise, S1725 performs an operation to provide a display indicating that there was an error and then the subroutine returns.

At S1718, heating by the magnetron 12 at maximum output is continued and a search pattern for the entire heating chamber 10 is begun.

Next, S1719 determines whether Sset is 80 deg C. or less. If so, the operation proceeds to S1720, Tmax is set to 7 minutes, and the operation proceeds to S1722.

At S1721, Tmax is set to 11 minutes and the operation proceeds to S1722.

S1722 waits for Smax to reach Sset. When this occurs, the operation proceeds to S1723.

At S1723, after the heating operation by the magnetron 12 stops, the rotation of the auxiliary antenna 21 is stopped at the reset position and the subroutine returns.

With the custom temperature option operations described above, if S1706 determines that Sset is 10 deg C. or less, the fields of view 70*a* of the infrared sensor 7 are fixed to a position that includes the position where Smin was detected. This is done because Smin is assumed to be lower than standard temperature and also sufficiently lower than the tray temperature. Thus, moving the fields of view 70*a* during the heating operation can lead to a significant error being introduced to Smin. This operation prevents reduced precision of detection output from the infrared sensor 7.

5) Operations Associated with the Tuber Option

Figure 21:
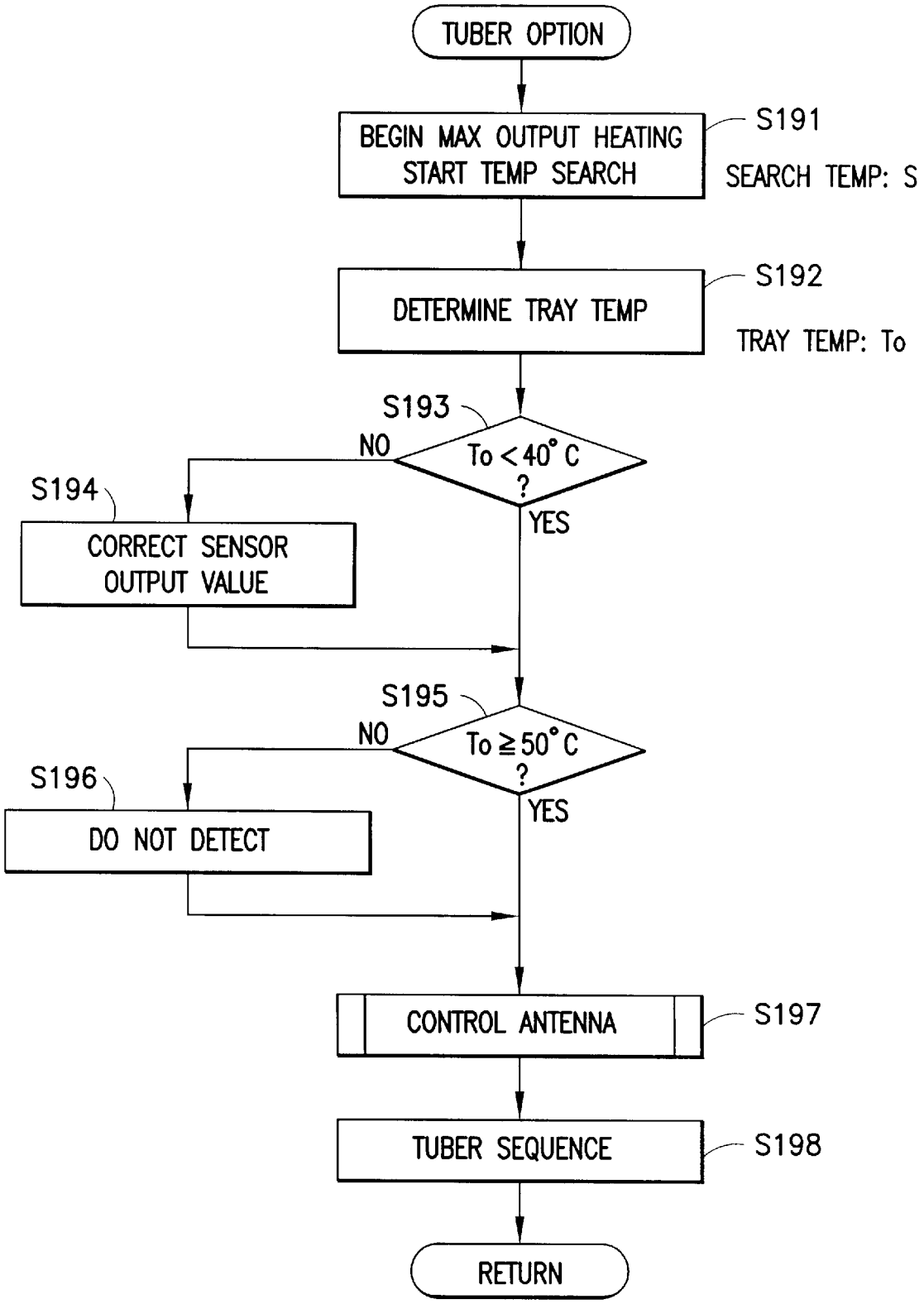
FIG. 21 is a flowchart of a subroutine for the tuber mode option of FIG. 16.

The operations associated with the tuber option are described. FIG. 21 is a flowchart of the subroutine for the tuber option operations (S19) from FIG. 16.

At S191, the magnetron 12 begins performing heating operations at maximum output, the auxiliary antenna 21 is rotated, and temperature detection for the entire bottom surface 9*a* is started. Next, S192 determines the tray temperature T0 in a manner similar to S1002 (see FIG. 17).

Next, S193 determines whether T0 is less than 40 deg C. If so, the operation proceeds to S195. Otherwise, at S194, correction is applied to the detection output from the infrared sensor 7 in the same manner as in S1004 (see FIG. 17), and the operation proceeds to S195.

S195 determines whether any position has a T0 of 50 deg C. or more. If such a position is found, the operation proceeds to S196. A setting is made to eliminate temperature detection from the current heating operation and the operation proceeds to S197. If no such position was found, the operation proceeds directly to S197.

At S197, the antenna control operation described using FIG. 18 is performed.

Next, at S198, the tuber sequence is executed, and the subroutine returns.

In the tuber sequence, heating is continued while the following operations are performed. First, the time it takes from the beginning of the heating operation to when any position in the heating chamber 10 reaches 80 deg C. is detected as T80. Then, once a position in the heating chamber 10 has reached 80 deg C., heating is continued for an interval determined by multiplying a predetermined coefficient to T80. In this tuber option sequence, if no position is determined to reach 80 deg C., the heating operation is stopped after a maximum of 5 minutes.

In the tuber option operations described above, positions with T0 at 50 deg C. at S195 are excluded from temperature detection. This is done to avoid errors in which areas already having high temperatures, e.g., areas from which hot food has been removed, but are detected as still containing hot food.

The examples described for the embodiment presented above are not restrictive, and the breadth of the present invention is defined by the scope of the claims rather than the descriptions above. The present invention includes all changes within the scope and equivalent scope of the claims.

Also, the technologies described for the different options are applied to the microwave oven 1 by themselves or in combination.

Also, the number of infrared detection elements in the infrared sensor 7 is not restricted to eight. Any number of infrared detection elements, including one, can be used. If necessary, the infrared sensor 7 can be moved in two dimensions, i.e., in an x/y scan along two perpendicular directions, rather than just the one dimension indicated by the arrows 99 or the like.

In the embodiment described above, the auxiliary antenna 21 is stopped directed in any one of orientation 1 through orientation 8 depending on where the food to be heated in a concentrated manner is placed in the heating chamber 10.

The position of the food to be heated in a concentrated manner was determined based on the detection output of the infrared sensor 7. However, in the microwave oven 1, it is also possible to predetermine the placement position for food to be heated in a concentrated manner. Alternatively, the position can be determined by the user each session by performing predetermined key operations on the input panel 6.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A microwave oven comprising:

a heating chamber for holding food;

a microwave source for producing microwaves to heat said food;

an irradiation antenna guiding said microwaves produced by said microwave source to said heating chamber;

an antenna controller;

said microwave source being effective, when said microwave source is performing a heating operation, to control said irradiation antenna in an alternating manner between a first mode wherein said microwaves from said microwave source are guided over an entirety of said heating chamber and a second mode wherein said microwaves are guided to a specific area in said heating chamber;

a placement position determining module;

said placement position determining module including means for determining a placement position for a food item that is to be heated in a localized manner inside said heating chamber; wherein said specific area is said placement position of said food item to be heated in a localized manner;

a temperature detector;

said temperature detector including means for detecting temperatures at a plurality of locations in said heating chamber; and said antenna controller includes means for determining whether to control said irradiation antenna using said full heating mode or said localized heating mode depending on a temperature increase value within a predetermined time of a location detected by said temperature detector as having a lowest temperature when said microwave source begins heating.

2. A microwave oven according to claim 1, further comprising:

an antenna rotation module for rotating said irradiation antenna; and said antenna control module including means for controlling said irradiation antenna in said first mode by rotating said antenna rotation module and in said second mode by stopping said irradiation antenna at a predetermined position.

3. A microwave oven according to claim 1, wherein said antenna controller includes means for selecting between a full heating mode wherein an entirety of said heating chamber is heated by controlling said irradiation antenna in said first mode and a localized heating mode wherein localized heating of said specific location in said heating chamber is performed by alternately controlling said irradiation antenna between said first mode and said second mode.

4. A microwave oven comprising:

a heating chamber for holding food;

a microwave source for producing microwaves to heat said food;

an irradiation antenna guiding said microwaves produced by said microwave source to said heating chamber;

an antenna controller;

said microwave source being effective, when said microwave source is performing a heating operation, to control said irradiation antenna in an alternating manner between a first mode wherein said microwaves from said microwave source are guided over an entirety of said heating chamber and a second mode wherein said microwaves are guided to a specific area in said heating chamber;

a temperature detector;

said temperature detector including means for detecting temperatures at a plurality of locations in said heating chamber; and a placement position determining module;

said placement position determining module including a means for determining a placement position of said food item to be heated in a localized manner to be a location with a maximum temperature increase value within a predetermined time when said microwave source is performing said heating operation and said irradiation antenna is being controlled in said first mode; and said antenna controller includes means for determining whether to control said irradiation antenna using said full heating mode or said localized heating mode depending on a temperature increase value within a predetermined time of a location detected by said temperature detector as having a lowest temperature when said microwave source begins heating.

5. A microwave oven comprising:

a heating chamber for holding food;

a microwave source for producing microwaves to heat said food;

an irradiation antenna guiding said microwaves produced by said microwave source to said heating chamber;

an antenna controller;

said microwave source being effective, when said microwave source is performing a heating operation, to control said irradiation antenna in an alternating manner between a first mode wherein said microwaves from said microwave source are guided over an entirety of said heating chamber and a second mode wherein said microwaves are guided to a specific area in said heating chamber;

a placement position determining module;

said placement position determining module including means for determining a placement position for a food item that is to be heated in a localized manner inside said heating chamber; wherein said specific area is said placement position of said food item to be heated in a localized manner;

a temperature detector for detecting a temperature in said heating chamber;

said temperature detector includes a plurality of infrared detector elements with fields of vision that include different locations in said beating chamber;

wherein said antenna controller includes means for selecting between a full heating mode wherein an entirety of said heating chamber is heated by controlling said irradiation antenna in said first mode and a localized heating mode wherein localized heating of said specific location in said heating chamber is performed by alternately controlling said irradiation antenna between said first mode and said second mode; and said antenna controller determines whether to control said irradiation antenna using said full heating mode or said localized heating mode depending on a number of said plurality of infrared detector elements detecting temperatures within a predetermined value of each other.

* * * * *